US011145440B2

(12) United States Patent
Rogers

(10) Patent No.: US 11,145,440 B2
(45) Date of Patent: Oct. 12, 2021

(54) METHOD OF TESTING A FIRE RESISTANT COAXIAL CABLE

(71) Applicant: American Fire Wire, Inc., Minden, NV (US)

(72) Inventor: William E. Rogers, Danville, CA (US)

(73) Assignee: American Fire Wire, Inc., Minden, NV (US)

( * ) Notice: Subject to any disclaimer, the term of this patent is extended or adjusted under 35 U.S.C. 154(b) by 0 days.

(21) Appl. No.: 16/378,199

(22) Filed: Apr. 8, 2019

(65) Prior Publication Data

US 2019/0237221 A1 Aug. 1, 2019

Related U.S. Application Data

(60) Division of application No. 15/711,206, filed on Sep. 21, 2017, now Pat. No. 10,283,239, which is a (Continued)

(51) Int. Cl.
*H01B 11/18* (2006.01)
*H01B 7/295* (2006.01)

(52) U.S. Cl.
CPC ..... *H01B 11/1834* (2013.01); *H01B 7/295* (2013.01); *H01B 11/1813* (2013.01); *H01B 11/1869* (2013.01); *Y10T 29/49123* (2015.01)

(58) Field of Classification Search
CPC ..... Y10T 29/49123; Y10T 29/49117; Y10T 29/49002; H01L 11/1834; H01L 11/1813; H01L 11/1869; H01L 7/295
(Continued)

(56) References Cited

U.S. PATENT DOCUMENTS 3,299,202 A 1/1967 Brown
3,567,846 A 3/1971 Brorein et al.
(Continued)

FOREIGN PATENT DOCUMENTS

CN 201421874 3/2010
CN 202384468 8/2012
(Continued)

OTHER PUBLICATIONS

3M™ Nextel™ Ceramic Fibers and Textiles, 3M Science Applied to Life, retrived on Nov. 9, 2016 at http://www.3m.com/3M/en-US/company-us/all-3m-products/~/All-3M-Products/Chemicals-Advanced-Materials/Advanced-Ceramics/Ceramic-Fibers-and-Textiles, 11 pages.
(Continued)

*Primary Examiner* — Peter Dungba Vo
*Assistant Examiner* — Azm A Parvez
(74) *Attorney, Agent, or Firm* — Kilpatrick Townsend & Stockton LLP

(57) ABSTRACT

Methods of testing and installing fire-resistant coaxial cables are described. The dielectric between the coax cable's central conductor and outer coaxial conductor ceramify under high heat, such as those specified by common fire test standards (e.g., 1850° F./1010° C. for two hours). The dielectric can be composed of ceramifiable silicone rubber, such as that having a polysiloxane matrix with inorganic flux and refractory particles. Because thick layers of uncured ceramifiable silicone rubber deform under their own weight when curing, multiple thinner layers are coated and serially cured in order to build up the required thickness. A sacrificial sheath mold is used to hold each layer of uncured ceramifiable silicone rubber in place around the central conductor while curing. The outer conductor can be a metal foil, metal braid, and/or corrugated metal. Another layer of extruded ceramifiable silicone dielectric or an outer wrap of ceramic
(Continued)

fiber yarn surrounds the outer conductor and continues to insulate it from the outside if a low smoke zero halogen jacket burns away.

19 Claims, 24 Drawing Sheets

Related U.S. Application Data continuation-in-part of application No. 15/385,585, filed on Dec. 20, 2016, now Pat. No. 9,773,585.

(58) Field of Classification Search
USPC ..... 29/828, 825, 592.1
See application file for complete search history.

(56) References Cited

U.S. PATENT DOCUMENTS

| | | | | |
|---|---|---|---|---|
| 3,590,141 | A | 6/1971 | Mildner | |
| 3,823,255 | A | 7/1974 | La Gase et al. | |
| 3,903,354 | A | 9/1975 | Dageforde | |
| 4,391,425 | A | 7/1983 | Keep, Jr. | |
| 5,227,586 | A | 7/1993 | Beauchamp | |
| 5,457,285 | A | 10/1995 | Faust et al. | |
| 6,049,647 | A * | 4/2000 | Register | G02B 6/4416 385/100 |
| 6,387,518 | B1 | 5/2002 | Wolfer et al. | |
| 7,304,245 | B2 | 12/2007 | Graeme et al. | |
| 7,538,275 | B2 * | 5/2009 | Konnik | H01B 3/46 174/110 R |
| 7,652,090 | B2 | 1/2010 | Alexander et al. | |
| 9,449,741 | B2 | 9/2016 | Abe et al. | |
| 9,450,352 | B2 | 9/2016 | Miyawaki | |
| 9,773,585 | B1 | 9/2017 | Rogers | |
| 10,283,239 | B2 | 5/2019 | Rogers | |
| 10,726,974 | B1 | 7/2020 | Rogers | |
| 2003/0055157 | A1 | 3/2003 | Wolfer et al. | |
| 2006/0175074 | A1 * | 8/2006 | Huffman | H01B 11/1826 174/102 R |
| 2010/0101824 | A1 * | 4/2010 | Fujimoto | H01B 3/423 174/110 SR |
| 2011/0209892 | A1 * | 9/2011 | Metz | H01B 11/1843 174/102 R |
| 2013/0299211 | A1 | 11/2013 | Pope | |
| 2014/0037956 | A1 | 2/2014 | Sopory | |
| 2015/0060106 | A1 | 3/2015 | Polasky | |
| 2015/0206625 | A1 * | 7/2015 | Kumada | H01B 11/1826 174/102 C |
| 2016/0093419 | A1 * | 3/2016 | Shin | H01B 7/295 174/107 |
| 2018/0174710 | A1 | 6/2018 | Rogers | |

FOREIGN PATENT DOCUMENTS

| | | |
|---|---|---|
| CN | 103753927 | 4/2014 |
| CN | 105913951 | 8/2016 |
| CN | 107768003 | 3/2018 |
| JP | 11-297128 | 10/1999 |

OTHER PUBLICATIONS

Alsecure® Premium Multicore Ceramifiablee, Alsecure® Premium Multicore, published Nov. 19, 2016, http://www.olex.com.au, 2 pages.

Ceram Polimerik—The World's Hottest Company in Fire Protection Technology, Global Intelligence of Fire Protection Industry Worldwide, Market Analysis of Projects and Developments, Fire Prevention-Active and Passive Fire Protection, Press Room, http://hkc22.com/fireprotectionindustry_pressroom_ceram_polymerik.html, retrieved on Nov. 18, 2016, 3 pages.

Ceramifiable Silicone Rubber Compound for Fire Resistant Cable—Anpin Silicone Material Co., Ltd., http://anpin.en.explaza.net/ceramifiable-silicone-rubber-compund-for--94686-3590090.html, retrieved on Sep. 26, 2016, 3 pages.

Di et al., "A novel EVA composite with simultaneous flame retardation and ceramifiable capacity," RSC Advances, 2015, vol. 5, pp. 51248-51257, DOI:10.1039/C5RA05781G.

Fire-Resistant Cables, Fanton, 1 page.

Korean Ceramifiable® cables that can take the heat, Nexans, http://www.nexans.com/eservice/navigation/NavigationPublicationOnly.nx?forPrint=true&publicationId=-33641, 1 page.

Pyrotenax, System 1850, 2-hour fire-rated, mineral insulated copper sheathed wiring cable, Terminal Building Solutions, Jul. 2015, 6 pages.

Wilson, Dean K., "Circuit Integrity Cable Re-examined," Consulting-Specifying Engineer, Mar. 1, 2002, http://www.csemag.com/industry-new/codes-and-updates/single-article/circuit-integrity-cable-re-examined, retrieved on Sep. 19, 2016, 2 pages.

* cited by examiner

BRAIDED COAX CABLE

CORRUGATED COAX CABLE

METHOD OF TESTING A FIRE RESISTANT COAXIAL CABLE

CROSS-REFERENCES TO RELATED APPLICATIONS

This is a divisional application of U.S. patent application Ser. No. 15/711,206, filed Sep. 21, 2017, which claims priority from and is a continuation-in-part (CIP) application of U.S. patent application Ser. No. 15/385,585, filed Dec. 20, 2016, which is hereby incorporated by reference in its entirety for all purposes.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

1. Field of the Invention

The present application generally relates to electrical cables, including selection of materials for their conductive, insulating, or dielectric properties. Specifically, the application is related to fire-resistant co-axial cables with ceramifiable silicone rubber or ceramic fiber dielectric between the conductors and outside of the outer conductor.

2. Description of the Related Art

Since the Sep. 11, 2001 attacks on the World Trade Center and Pentagon, there has been a world-wide emphasis on improving communications during emergencies. In the first minutes of an emergency, communication among civilians and first responders is often through wireless communication devices, such as cellular telephones. While wireless signals, being electromagnetic radiation typically in the radio frequency (RF) range, are impervious to damage and do not depend on wires for transmission, the wireless signals depend on other infrastructure to communicate. This infrastructure includes antennas, switching equipment, towers, repeaters—and wires.

Ground zero of a disaster, man-made or natural, is often localized to a particular geographic area. At least some local cell towers may be operational. But cell phones within large buildings often do not connect directly with cell towers. Such buildings, as well as shopping centers and stadiums, may have too many obstacles and reflections for conventional cell phone-to-tower connections. For example, the metal reflective film applied to glass facades of commercial buildings prevents transmission of RF energy outside the building. Or the buildings may simply be too large for RF signals to reach a nearby cell tower, such as is the case with stadiums.

A cellular distributed antenna system (DAS) is often employed within buildings and other facilities in order to facilitate transmission of signals between occupants' cell phones and local cell towers. Multiple antennas are located throughout the facility, such as on each floor. Signals to and from the distributed antennas are routed—by cable—through a central processing rack in the basement or on the first or top floor. One or more cables connects the central processing rack to an outside antenna that is pointed or otherwise configured to optimally communicate with a local cell tower. The outside antenna is often located on a building's roof.

An Emergency Responder Radio Coverage System (ERRCS) DAS may also be employed within facilities. An ERRCS DAS boosts radio signals for firemen, policemen, and other first responders, similarly to a cellular DAS.

If there is an emergency in the building, a DAS may be critical for communications. Firefighters and policemen need to communicate with one another while responding. Users should be able to communicate with the outside as well. It may be especially unnerving for users to have their otherwise-normally-operational cell phones experience an outage during a building emergency.

It is for these and other reasons that building fire codes require DASes to meet certain survivability standards. For example, building fire codes sometimes dictate that communication cables connecting the DAS's antennas to the central processing/head-end rack and communication cables running from the rack to the outside antenna maintain operation at 1010° C. (1850° F.) temperatures for two hours. This standard can be found among the NFPA 72 (National Fire Alarm and Signaling Code), ICC IFC 510 (International Fire Code), and NFPA 1221 (Standard for the Installation, Maintenance, and Use of Emergency Services Communications Systems) codes.

Yet no such fire-resistant cables exist in a coaxial configuration. To maintain spacing between the central and outer conductors, common coax cables employ dielectrics that are air-based (foam) or polymer. Plastic foam and polymers simply melt at high temperature. Therefore, in one large city with such building codes, building inspectors routinely grant waivers for DAS coax cables or require extensive fire shielding of the cables, such as boxing them in drywall soffits, to afford them the two-hour burn time.

There is a need in the art for more survivable coax communication cables.

BRIEF SUMMARY

Generally, a coaxial cable is described with a ceramifiable silicone rubber dielectric or a ceramic fiber dielectric between an inner, center conductor and a coaxial, outer conductor. When subjected to temperatures exceeding 1010° C. (1850° F.), the ceramifiable dielectric maintains its structural integrity by ceramifying. That is, the resilient dielectric turns into a brittle, porous ceramic structure.

Ceramifiable silicone rubber can be comprised of inorganic flux particles and refractory particles in a polysiloxane (silicone rubber) matrix. At temperatures from about 425° C. (800° F.) to 482° C. (900° F.) the polysiloxane matrix begins to burn off. Meanwhile, the inorganic flux particles soften and flow to connect refractory materials, forming a porous ceramic structure.

Under similar high temperatures, a ceramic fiber dielectric maintains its integrity because it is composed of refractory fibers.

In addition to the dielectric, the coaxial cable has a ceramifiable silicone rubber layer or a ceramic fiber wrap layer around the outer conductor and underneath a low smoke zero halogen (LSZH, LSOH, LS0H, LSFH, or OHLS) jacket. The coax cable's outer conductor, sometimes called the ground or shield, can be corrugated or consist of a metal foil protected by a metal braiding.

Some embodiments of the invention are related to a fire resistant coaxial cable apparatus including a center conductor, a first layer of a tubular or other shape ceramifiable silicone rubber dielectric surrounding the center conductor, the ceramifiable silicone rubber dielectric comprising inorganic flux particles and refractory particles in a polysiloxane matrix, the ceramifiable silicone rubber dielectric configured to convert from a resilient elastomer to a porous ceramic when heated above 425° C. or other temperature, a second layer of ceramifiable silicone rubber dielectric surrounding the first layer, the first layer having at least partially cured independently from the second layer such that the first and second layers are distinct from one another, an outer conductor surrounding the first and second layers of ceramifiable silicone rubber dielectric, the dielectric configured to maintain a predetermined spacing between the center conductor and the outer conductor, and a refractory insulating jacket surrounding the outer conductor.

The first layer of ceramifiable silicone rubber dielectric can be cured completely separately from the second layer such that there exists no cross-linking of polymer chains between the first and second layers.

The center conductor can include a single solid wire or multiple wire strands bundled together.

The first layer of ceramifiable silicone rubber dielectric can directly touch the center conductor. The apparatus can include a third layer of ceramifiable silicone rubber dielectric surrounding the second layer, the second layer having at least partially cured independently from the third layer such that the second and third layers are distinct from one another.

The center conductor can have a diameter of 4.6 millimeters (0.18 inches), and the ceramifiable silicone rubber dielectric can have a diameter greater than 13 millimeters (0.5 inches) or 19 millimeters (0.75 inches). This makes for a ceramifiable silicone rubber dielectric thickness of greater than 4.2 millimeters (0.17 inches) or 7.2 millimeters (0.28 inches).

The cable can include a silicone glass tape between the dielectric and the outer conductor. It can also include a low smoke zero halogen outer jacket surrounding the inner jacket.

A plastic film can be between the second layer of ceramifiable silicone rubber dielectric and the outer conductor.

The outer conductor can include a metal foil, and the metal foil can include copper or aluminum. Either can be on a metalized tape. The cable can include a braided metal in direct contact with and surrounding the outer conductor. The braided metal can include tin-coated copper.

The outer conductor can include a corrugated metal. For example, the corrugated metal can have a wall thickness of 0.53 millimeters (0.021 inches), and the corrugations of the corrugated metal can have a layer thickness of 1.8 millimeters (0.070 inches). The outer conductor can include copper.

The cable can have an outer diameter of 15.7 millimeters (0.620 inches), thereby having a ½ inch nominal size, all the way to 28 millimeters (1.1 inches), thereby having a 1.1 inch nominal size, or more.

The cable can include a plastic sheath, and a ceramifiable silicone rubber jacket surrounding the plastic sheath.

The refractory insulating jacket can include a ceramic fiber wrap inner jacket comprising fiber material selected from the group consisting of refractory aluminoborosilicate, aluminosilica, and alumina.

Embodiments also include a fire resistant coaxial cable apparatus including a center conductor, a tubular ceramifiable silicone rubber dielectric surrounding the center conductor, the ceramifiable silicone rubber dielectric comprising inorganic flux particles and refractory particles in a polysiloxane matrix, the ceramifiable silicone rubber dielectric configured to convert from a resilient elastomer to a porous ceramic when heated above 425° C., an outer conductor surrounding the dielectric, and a ceramic fiber wrap inner jacket surrounding the outer conductor, with all of the optional elements as described above.

For example, the ceramic fiber wrap inner jacket can include a fiber material of refractory aluminoborosilicate, aluminosilica, or alumina. The fiber material can include fibers having diameters of between 7 and 13 microns (μm).

The outer conductor can include a metal foil surrounded by a braided metal in direct contact with and surrounding the outer conductor. Alternatively, the outer conductor can include a corrugated metal.

Embodiments also include a fire resistant coaxial cable apparatus including a center conductor, a ceramic fiber wrap dielectric surrounding the center conductor, an outer conductor surrounding the dielectric, the dielectric configured to maintain a predetermined spacing between the center conductor and the outer conductor when heated above 1010° C. or other temperature, and a ceramifiable silicone rubber inner jacket or a ceramic fiber wrap layer surrounding the outer conductor.

The outer conductor can include a metal foil surrounded by a braided metal in direct contact with and surrounding the outer conductor. Alternatively, the outer conductor can include a corrugated metal.

Embodiments include a method of installing a fire resistant coaxial cable, the method including providing a coaxial cable having a center conductor surrounded by a ceramifiable silicone rubber dielectric or a ceramic fiber wrap dielectric, which is surrounded by an outer conductor, which is surrounded by a ceramifiable silicone rubber layer or a ceramic fiber wrap inner jacket, which is surrounded by a low smoke zero halogen outer jacket. The method includes pulling or pushing the coax cable through a conduit and connecting the coax cable to an antenna of a distributed antenna system.

Embodiments include a method of testing a fire resistant coaxial cable, the method including providing a coaxial cable having a center conductor surrounded by a ceramifiable silicone rubber dielectric or a ceramic fiber wrap dielectric, which is surrounded by an outer conductor, which is surrounded by a ceramifiable silicone rubber inner jacket or a ceramic fiber wrap inner jacket, which is surrounded by a low smoke zero halogen outer jacket. The method includes subjecting the coaxial cable to 1010° C. heat, ceramifying the ceramifiable silicone rubber layer or the ceramic fiber wrap, burning at least a portion of the outer jacket from the cable, and passing an electric voltage or current signal through the coaxial cable after the ceramifying and the burning.

The ceramifying of the ceramifiable silicone rubber inner jacket can include burning away a polysiloxane matrix and melting inorganic flux particles such that the flux particles connect between refractory filler particles.

The method can include resting the coaxial cable on a metal surface, wherein the burning of the outer jacket exposes the ceramifiable silicone rubber inner jacket or the ceramic fiber wrap inner jacket to the metal surface, the ceramifiable silicone rubber inner jacket or the ceramic fiber wrap inner jacket preventing the outer conductor from contacting the metal surface.

Embodiments include a method of manufacturing a fire resistant coaxial cable. The method includes extruding a first layer of uncured ceramifiable silicone rubber dielectric over a center conductor, the ceramifiable silicone rubber dielectric comprising inorganic flux particles and refractory particles in a polysiloxane matrix, the ceramifiable silicone rubber dielectric configured to convert from a resilient elastomer to a porous ceramic when heated above 425°; coating the first layer of uncured ceramifiable silicone rubber dielectric with a sheath mold, partially or fully curing the first layer of uncured ceramifiable silicone rubber dielectric within the sheath mold, stripping the sheath mold from the cured first layer, extruding a second layer of ceramifiable silicone rubber dielectric over the cured first layer, encasing the second layer of ceramifiable silicone rubber dielectric with an outer conductor, and insulating the outer conductor with a refractory insulating jacket.

The sheath mold can be a first sheath mold, and the method can further include coating the second layer of ceramifiable silicone rubber dielectric with a second sheath mold, partially or fully curing the second layer of ceramifiable silicone rubber dielectric within the second sheath mold, and stripping the second sheath mold from the cured second layer.

The method can further include coiling the sheath mold coated first layer of uncured ceramifiable silicone onto a cable spool, moving the cable spool into an oven, and baking the ceramifiable silicone rubber dielectric at an air temperature above 200° C. in the oven in order to partially or fully cure it. The partially or fully curing can include baking the ceramifiable silicone rubber dielectric at an air temperature above 200° C. The baking can include warming an air temperature to above 200° C. by no more than 3° C. per minute; and cooling the air temperature to room temperature by no more than 3° C. per minute after baking, thereby avoiding thermally shocking the ceramifiable silicone rubber dielectric.

The encasing can include wrapping a plastic film metalized with metal foil around the second layer, and braiding a metal braid around the metal foil. The insulating can include taping a plastic sheath around the metal braid, and extruding a ceramifiable silicone rubber jacket around the plastic sheath. The insulating can include swathing the outer conductor with a ceramic fiber wrap inner jacket comprising fiber material selected from the group consisting of refractory aluminoborosilicate, aluminosilica, and alumina. The insulating can include enclosing the refractory insulating jacket with a low smoke zero halogen (LSZH) outer jacket.

DETAILED DESCRIPTION

Figure 1:
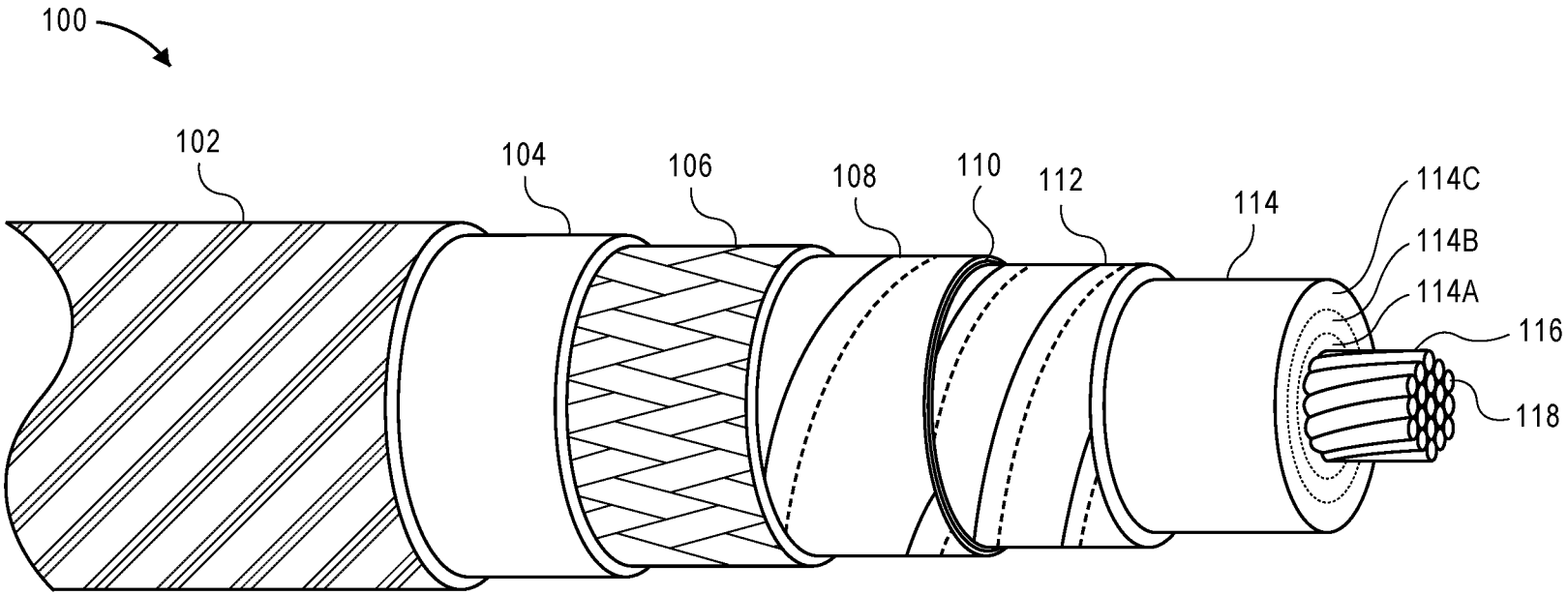
FIG. 1 is a cut-away perspective view of a braided coaxial cable in accordance with an embodiment.

Fire resistant coaxial cable is described. Some embodiments of the cable can survive two hours in fire conditions of 1010° C. (1850° F.), which is a common fire rating, maintaining (or increasing where it does not matter) dielectric spacing and avoiding shorting to allowing radio frequency (RF) signals to pass. This coaxial cable may be suitable for meeting building codes for a distributed antenna system (DAS) without the need for fire-protective soffits, conduits, or other expensive shielding.

Flexible braided cables and durable corrugated cables, among other cable types, are described. Braided cables as described can be suitable for replacing 50Ω LMR®-600 flexible communication cable manufactured by Times Microwave Systems, Inc. of Wallingford, Conn., United States, among other types.

A "ceramifiable" material includes a material that turns from a flexible material into a ceramic when exposed to high temperatures, such as over 425° C., 482° C., 1010° C., or as otherwise known in the art. The material can be a composition of component materials that have different melting ranges. The lowest-melting temperature component materials may melt at 350° C. Between 425° C. and 482° C., other component materials of the material my devitrify, passing from a glass-like state into a crystalline state. Additives can bond refractory fillers together, forming a porous ceramic material. A material configured to convert from a resilient elastomer to a porous ceramic when heated above 425° can include initial, partial, or full conversion to ceramic when air temperature surrounding is heated above 425°.

An example ceramifiable polymer may be the peroxidically crosslinking or condensation-crosslinking polymer described in U.S. Pat. No. 6,387,518.

A "ceramifiable silicone rubber" includes silicone polymer (polysiloxane) with additives that cause the material to turn into a fire-resistant ceramic in high temperature fire conditions, or as otherwise known in the art. This may include peroxide crosslinking or condensation-crosslinking high consistency silicone rubber. A silicone polymer matrix can include low-melting point inorganic flux particles and refractory filler particles in a polysiloxane matrix. Example products include, but are not limited to: Ceramifiable Silicone Rubber Compound RCS-821 manufactured by Shenzhen Anpin Silicone Material Col, Ltd. of Guangdong, China; ELASTOSIL® R 502/75 compound manufactured by Wacker-Chemie GmbH of Munich, Germany; and XIAMETER® RBC-7160-70 compound manufactured by Dow Corning Corporation of Midland, Mich., United States of America.

A "ceramic fiber wrap" includes a textile that includes microscopic ceramic fibers and fillers that maintain structural integrity at high temperatures. Example products include NEXTEL® ceramic fibers and textiles manufactured by 3M Corporation of Saint Paul, Minn., United States of America. 3M NEXTEL® textiles include aluminoborosilicate, aluminosilica, and alumina (aluminum oxide $Al_2O_3$) fibers with diameters ranging from 7 microns to 13 microns. Per the World Health Organization (WHO), fiber diameters above 3 microns (with length greater than 5 microns with a length-to-diameter ration greater than 3:1) are not considered respirable.

A "refractory" material includes non-metallic material having those chemical and physical properties that make them applicable for structures, or as components of systems, that are exposed to environments above 1,000° F. (811 K; 538° C.) (ASTM C71), or as otherwise known in the art.

A "low smoke zero halogen" or "low smoke free of halogen" (LSZH or LSOH or LS0H or LSFH or OHLS) is a material classification typically used for cable jacketing in the wire and cable industry. LSZH cable jacketing is composed of thermoplastic or thermoset compounds that emit limited smoke and no halogen when exposed to high sources of heat.

A "radial thickness" includes a layer thickness, or as otherwise known in the art. On a circular cross-sectioned cable, the radial thickness is the distance along a radial line from one point to another point. This is distinguished from a tangential, secant, axial, or other distance.

MYLAR® polyester film is trade name of E. I. du Pont de Nemours and Company, Wilmington, Del., U.S.A., for a biaxially-oriented polyethylene terephthalate (boPET) product. MELINEX® moldable plastic film produced by Imperial Chemical Industries Ltd. Corp. of London, U.K., and Hostaphan (formerly®) produced by Hoechst Aktiengesellschaft Corp. of Frankfurt, Germany, are similar boPET products.

FIG. 1 is a perspective view of a coaxial cable 100 that has layers cut away. The cable essentially has a round cross section and is radially symmetric around an axial centerline.

Center conductor 116 includes nineteen strands of individual wires 118 that are bundled and twisted together. Each individual wire is nickel-plated copper.

Radially surrounding the center conductor is ceramifiable silicone rubber dielectric 114 in a cylindrical, tubular form. Center conductor 116 is symmetrically centered in the dielectric.

Because silicone rubber can be difficult to extrude in the thicknesses needed for proper spacing between the center and outer conductor, dielectric 114 may exhibit multiple layers that are partially cured with each other. To create the large thickness shown in the figure, ceramifiable silicone rubber layer 114A was extruded in a first batch process around the center conductor and partially cured. Ceramifiable silicone rubber layer 114B was then extruded in a second batch process around layer 114A and partially cured, forming some cross-links between the layers. Finally, ceramifiable silicone rubber layer 114C was extruded in a third batch process around layer 114B and cured, forming cross-links between the layers.

If the entire thickness of ceramifiable silicone rubber dielectric were extruded all in one batch, the silicone rubber may not harden to the point where it can support the weight of the inner conductor. If that were the case, then the inner conductor could sag or otherwise move within the soft silicone rubber, becoming uncentered.

Multiple passes through an extrusion machine, each pass increasing an extrusion orifice diameter, helps prevent this problem. A tunnel of ultraviolet (UV) lights can shine onto the layers as they exit the orifice, helping to speed curing.

Alternatively or in addition, the ceramifiable silicone rubber layer can be coated with a quick-curing polymer or other material that acts as a sacrificial mold. The mold-enclosed uncured layer is wrapped around a large spool, hauled into an over, and baked. The baking cures the ceramifiable silicone rubber layer. The sacrificial mold is then peeled away from the fully- or partially-cured ceramifiable silicone rubber, and the next layer is extruded over it.

Ceramifiable silicone rubber layer 114C can be surrounded by wrapping it with silicone glass separator tape 112. As shown in the figure, separator tape 112 has a 25% overlap. Silicone glass separator tape 112 helps hold the thick outer layer 114C of silicone rubber dielectric 114.

Outer conductor 108 was formed from copper metallized tape wrapped around separator tape 112. The metallized tape was formed with copper over MYLAR® flexible film substrate 110.

Copper braiding 106 surrounds and is in direct contact with the copper metal of outer conductor 108. The braiding includes 36 AWG (American Wire Gauge) tin plated copper woven in a continuous fashion at a coverage of at least 85%.

Inner jacket 104 is another layer of ceramifiable silicone rubber. It surrounds braiding 106, enclosing it in a fire resistant shell.

Outer jacket 102 surrounds inner jacket 104. Outer jacket 102 is a low smoke zero halogen jacket, which protects the pliable silicone rubber of the inner jacket and slides more easily through walls and conduits. The outer jacket can be made of cross-linked irradiated polyolefin and can be colored in order to stand out from other non-emergency cables.

Example dimensions of a coax cable are shown in the following tables. These dimensions are not limiting.

TABLE 1

Ceramifiable Silicone Dielectric, Braided 1" Coax Cable

| Structure | Outer Diameter | Layer thickness | Material |
|---|---|---|---|
| Center conductor | 4.7 mm (0.185 in.) | 4.7 mm diameter | nickel plated copper, 19 strands of 0.0372" DIA |
| Dielectric | 19.8 mm (0.779 in.) | 7.5 mm | ceramifiable silicone rubber |
| Separator Tape | 20.4 mm (0.804 in.) | 0.3 mm | silicone glass with 25% nominal lap |
| Shield #1 foil | 20.5 mm (0.809 in.) | 0.06 mm | copper MYLAR ® flexible film tape with 25% nominal lap, copper side up |
| Shield #2 braid | 21.2 mm (0.834 in.) | 0.3 mm | 36 AWG tin plated copper braid, 85% min. coverage |
| inner jacket | 24.2 mm (0.954 in.) | 1.5 mm | ceramifiable silicone rubber |
| outer jacket | 27.4 mm (1.078 in.) | 1.6 mm | low smoke zero halogen |

TABLE 2

Ceramifiable Silicone Dielectric, Corrugated 1" Coax Cable

| Structure | Outer Diameter | Layer thickness | Material |
|---|---|---|---|
| Center conductor | 4.7 mm (0.185 in.) | 4.7 mm diameter | nickel plated copper, 19 strands of 0.0372" DIA |
| Dielectric | 19.8 mm (0.779 in.) | 7.5 mm | ceramifiable silicone rubber |
| Outer Conductor | 23.4 mm (0.920 in.) | 1.8 mm | corrugated copper |
| inner jacket | 26.4 mm (1.039 in.) | 1.5 mm | ceramifiable silicone rubber |
| outer jacket | 29.6 mm (1.165 in.) | 1.6 mm | low smoke zero halogen |

Figure 2A:
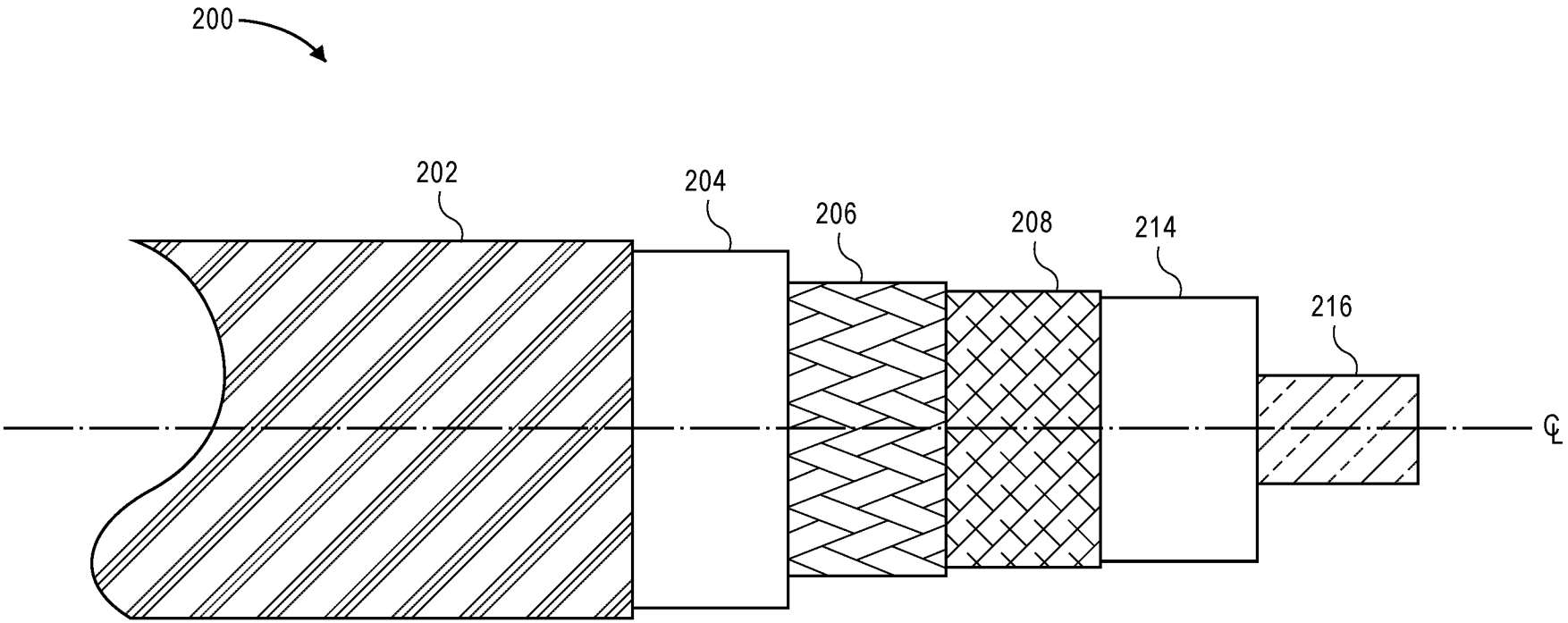
FIG. 2A is a cut-away side view of a braided coaxial cable in accordance with an embodiment.
Figure 2B:
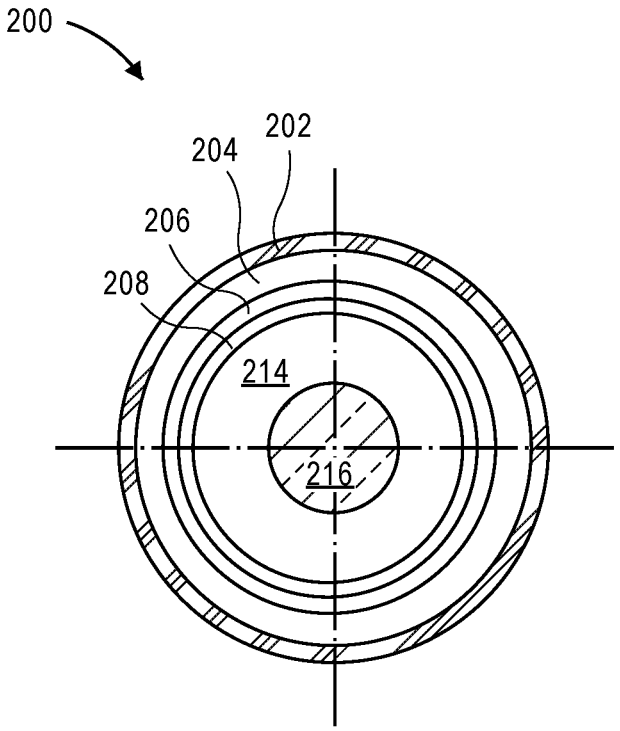
FIG. 2B is a cross section of the braided coaxial cable of FIG. 2A.

FIGS. 2A-2B are views of braided coaxial cable 200 in accordance with an embodiment. The cable has a round cross section and is radially symmetric around a centerline CL.

Similar to the embodiment shown in the previous figures, center conductor 216 is in direct contact with and surrounded by tubular ceramifiable silicone rubber dielectric 214.

The center conductor can copper or other electrically conductive metals, and it can be solid or multi-stranded. In some embodiments, the ceramifiable silicone rubber dielectric can be replaced by ceramic fiber wrap material.

Unlike the embodiment shown in the previous figure, outer conductor 208 is in direct contact with the dielectric. It includes an aluminum or copper foil, which is in direct contact with and surrounded by copper braid 206. Foil 208 presents a smooth, constant inner diameter of conductive metal across the dielectric from the inner conductor, whilst metal braid 206 offers additional conductive pathways for electrons to flow.

Ceramic fiber wrap inner jacket 204 is in direct contact with and surrounds metal braid 206. It is woven continuously around the outer conductor such that it completely covers the outer conductor.

Alternatively, the ceramic fiber wrap inner jacket can be replaced with ceramifiable silicone rubber.

Low smoke zero halogen jacket 202 surrounds ceramic fiber wrap inner jacket 204.

Figure 3A:
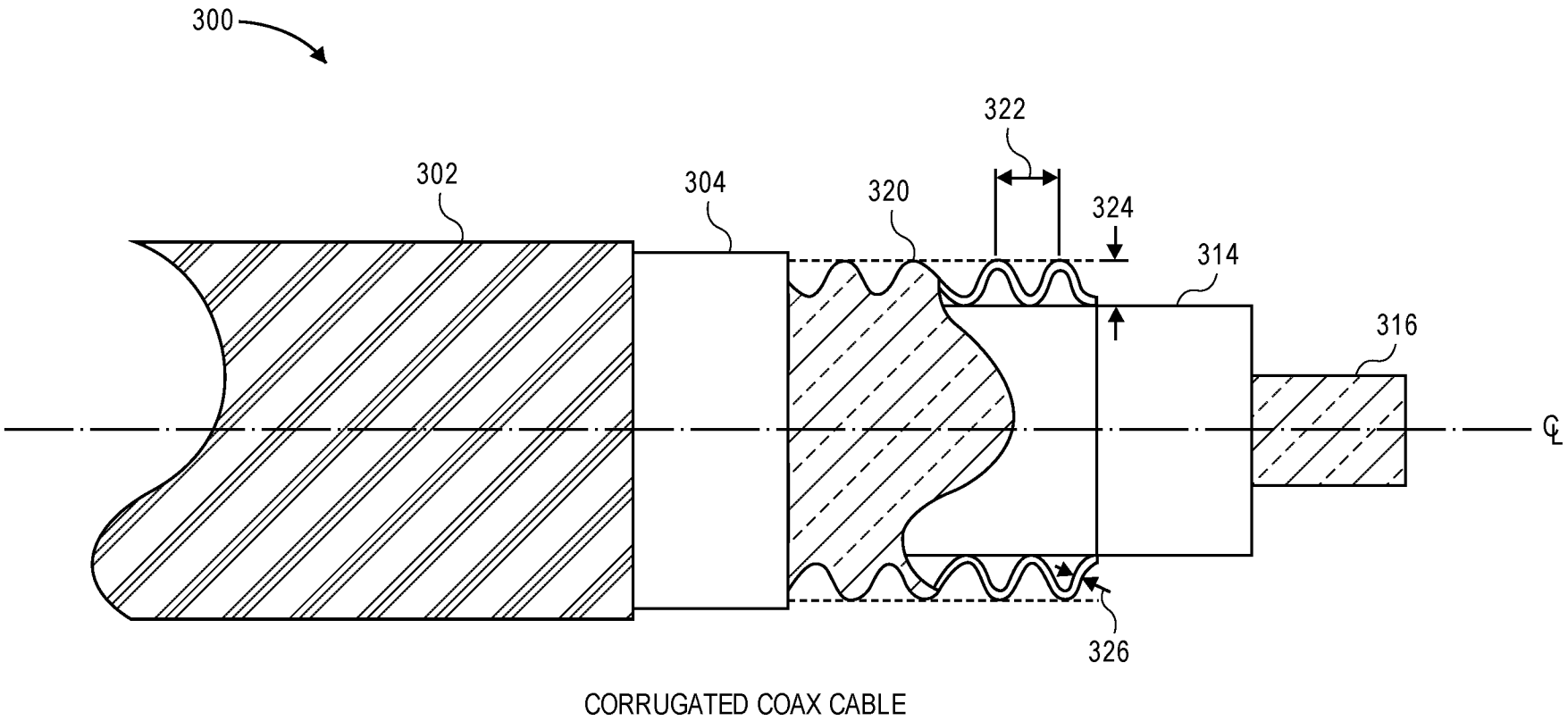
FIG. 3A is a cut-away side view of a corrugated coaxial cable in accordance with an embodiment.
Figure 3B:
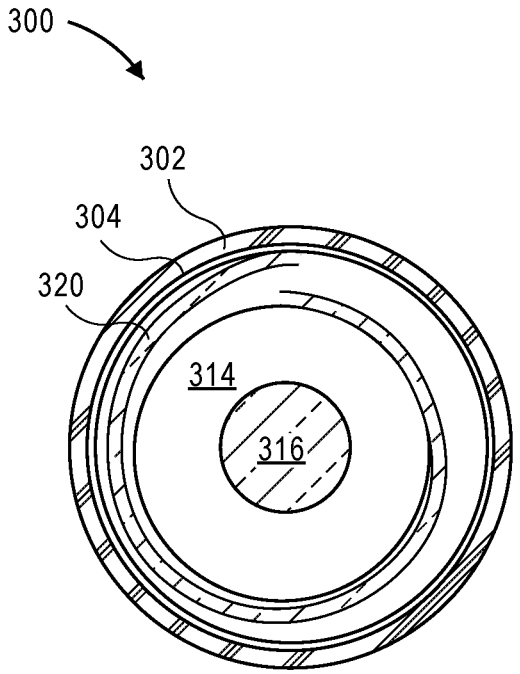
FIG. 3B is a cross section of the corrugated coaxial cable of FIG. 3A.

FIGS. 3A-B are views of corrugated coaxial cable 300 in accordance with an embodiment. The cable has a round cross section and is mostly radially symmetric around a centerline CL. Because the corrugations are helical, the cross section is not exactly symmetric along axial planes.

Center conductor 316 is composed of copper or another electrically conductive metal. The center conductor can be a single solid wire (as shown) or multiple smaller strands of wires twisted and bundled together.

Center conductor 316 is in direct contact with and surrounded by tubular ceramifiable silicone rubber dielectric 314. The silicone rubber dielectric can be continuously extruded around the center conductor or extruded in layers as described above.

In some embodiments, the dielectric can be a ceramic fiber wrap with dimensions to maintain a predetermined thickness depending on the dielectric constant of the ceramic fiber wrap material and desired electrical impedance (e.g., 50Ω, 75Ω) of the cable.

Corrugated metal outer conductor 320 is in direct contact with and surrounds tubular ceramifiable silicone rubber dielectric 314. The corrugated metal outer conductor is composed of a relatively thin metal wall with regularly spaced undulations. The metal can be copper or another electrically conductive metal. An infinitesimal radial cross section of the undulations may radially symmetric, or undulations may be helical.

In the exemplary embodiment, the undulations have a constant wall thickness 326 of 0.533 mm±0.076 mm (0.021 inches±0.003 inches). An amplitude-plus-wall-thickness dimension, or layer thickness 324 of the undulations is 1.78 mm (0.070 inches). A peak-to-peak wavelength 322 of the undulations is 2 corrugations per centimeter (5 corrugations per inch).

Ceramic fiber wrap layer 304 directly contacts and surrounds corrugated metal outer conductor 320. Ceramic fiber wrap layer is woven from a ceramic fiber yarn around the outer conductor such that it completely covers the outer conductor.

Alternatively, the ceramic fiber wrap layer can be replaced with ceramifiable silicone rubber.

Low smoke zero halogen jacket 302 surrounds ceramic fiber wrap layer 304. The jacket protects the cable from damage when it is fed and pulled through conduits. It also offers a relatively slippery surface to minimize force needed to push or pull the cable along conduits and raceways.

Further example dimensions of a braided coax cables are shown in the following tables for ⅞" and ½" embodiments. These dimensions are not limiting.

TABLE 3

| Ceramifiable Silicone Dielectric, Braided 7/8" Coax Cable Structure | | | |
|---|---|---|---|
| Type | Outer Diameter | Layer thickness | Material |
| Center conductor | 4.57 mm (0.180 in.) | 4.6 mm diameter (0.180 in.) | annealed copper |
| Dielectric | 15.24 mm (0.60 in.) to 19.81 mm (0.78 in.) | 5.3 mm (0.21 in.) to 7.62 mm (0.30 in.) | ceramifiable silicone rubber |
| Outer conductor | 15.5 mm (0.61 in.) to 20.1 mm (0.79 in.) | 0.13 mm (0.005 in.) | aluminum tape |
| Overall braid | 15.6 mm (0.64 in.) to 20.8 mm (0.82 in.) | 0.38 mm (0.015 in.) | tinned copper |
| Fire jacket | 15.7 mm (0.66 in.) to 21.0 mm (0.82 in.) | 0.089 mm (0.0035 in.) | ceramic fiber wrap |
| Jacket | 15.9 mm (0.72 in.) to 21.2 mm (0.83 in.) | 0.076 mm (0.003 in.) | low smoke zero halogen |

TABLE 4

| Ceramifiable Silicone Dielectric, Braided 1/2" Coax Cable Structure | | | |
|---|---|---|---|
| Type | Outer Diameter | Layer Thickness | Material |
| Center conductor | 4.57 mm (0.180 in.) | 4.6 mm diameter (0.180 in.) | annealed copper |
| Dielectric | 11.43 mm (0.450 in.) | 3.6 mm (0.14 in.) | ceramifiable silicone rubber |
| Outer conductor | 11.68 mm (0.460 in.) | 0.25 mm (0.01 in.) | aluminum tape |
| Overall braid | 12.45 mm (0.490 in.) | 0.51 mm (0.02 in.) | tinned copper |
| Fire jacket | 14.22 mm (0.560 in.) | 1.0 mm (0.04 in.) | ceramic fiber wrap |
| Jacket | 15.75 mm (0.620 in.) | 0.76 mm (0.03 in.) | low smoke zero halogen |

Figure 4:
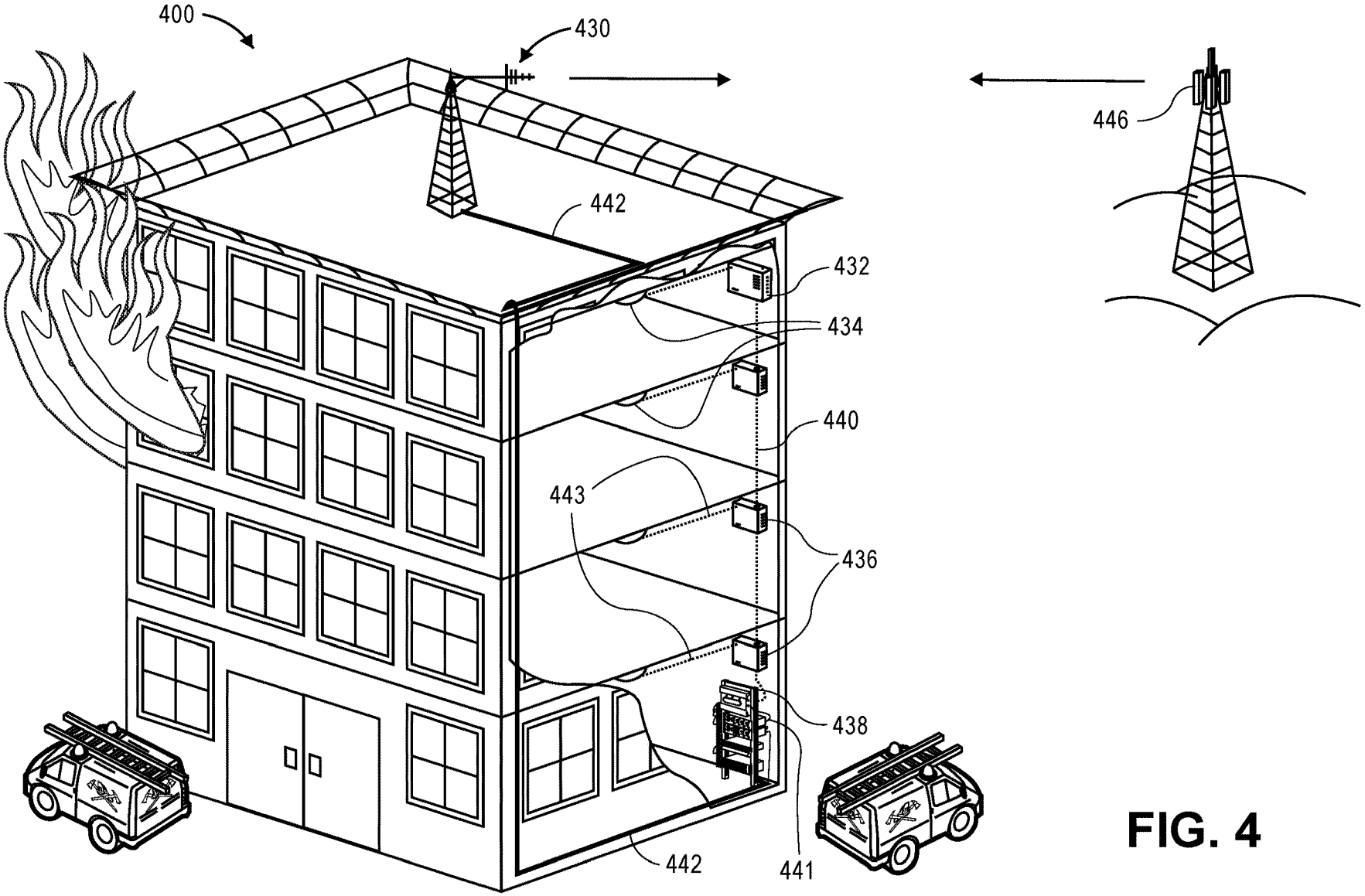
FIG. 4 is an illustration of installed cables in a building distributed antenna system in accordance with an embodiment.

FIG. 4 is an illustration of installed cables in a building distributed antenna system in accordance with an embodiment.

Building 400 has a cellular distributed antenna system (DAS) and/or Emergency Responder Radio Coverage System (ERRCS) DAS installed. That is, a fire resistant coax cable as described above has been pulled or pushed through conduit and affixed inside and outside of the building, connecting to antennae and other systems.

Head-end rack 438 has been installed in an equipment room on the ground floor of building 400. Within head-end rack 438 is housed an optical master unit and other rack-mounted devices. Fiber optic cable 440 connects the head-end rack 438 to remote access units, including optical signal splitters 436 on each floor and remote access unit 432 on the top floor. Optical signal splitters 436 and remote access unit 432 provide the functions of converting and amplifying optical to electrical signals and back again for their respective floor's antenna units. Signal splitters 436 pull off and repeat optical signals from optical cables 440.

On each floor are indoor antennas 434 that wirelessly connect with users' cellular telephones. Antennae 434 are connected to optical signal splitters 436 and remote access unit 432 by coax cables 443, in accordance with an embodiment.

Coax cables 443 are fire resistant in accordance with embodiments herein. Coax cables 443 can maintaining operation for over two hours at high temperatures. Therefore, building codes may not require coax cable 443 to be shielded from open air where fire can occur. That is, when using this cable, no additional drywall soffits, fire proof conduit, or other expensive structures may be needed to comply with building codes.

Within the head-end rack 438, fire resistant coax cable 441 can connect different rack-mounted devices. Although the equipment room in which head-end rack is situated may be fire proof, this additional cabling may incrementally harden the system to fire damage.

Fire resistant coax cable 442 runs from head-end rack 438 up the side of the building to roof mounted donor antenna 430. Donor antenna 430 is pointed at local cell tower 446 for an optimal signal.

In operation, communications from end users' cell phones goes to indoor antennae 434 and are then fed to optical splitters 436 through fire resistant coax cables 443. Fiber optic cables 440 bring the communications signals to the head end unit on the ground floor, which then sends the signals through fire resistant coax cable 442 to the roof. At the roof, donor antenna 430 sends the signals from coax cable 442 to cell tower 446. Opposite direction communication signals follow a reverse path.

During a building fire, explosion, or other emergency, coax cables 443, 442, and 441 may be exposed to an inferno of high temperatures. The low smoke zero halogen jacket may burn away. Yet while the insulation of other wires may burn and sublimate and allow their conductors to short out, an embodiment's ceramifiable silicone rubber or ceramic fiber wrap surrounding the outer conductor largely maintains its form, if not strength and structural integrity. The ceramic matrix from the ceramified silicone rubber, or the ceramic fiber wrap, does not allow the outer conductor of the coax to electrically short against metal conduit or other wires.

Further, the dielectric, so important in coaxial cables for its impedance and maintaining spacing between an inner conductor and coaxial outer conductor, merely ceramifies under the intense heat. Its polysiloxane matrix melts away while inorganic flux particles flow and join refractory particles. This leaves a microporous ceramic material. Although the resulting ceramic material may be brittle, its brittleness should not be an issue because nothing should move the cable. The cable is already installed an in place. At least until first responders can rescue victims and put out the blaze, their communications can depend on the wires.

After the fire is out, the ceramified coax cables may be replaced.

Figure 5:
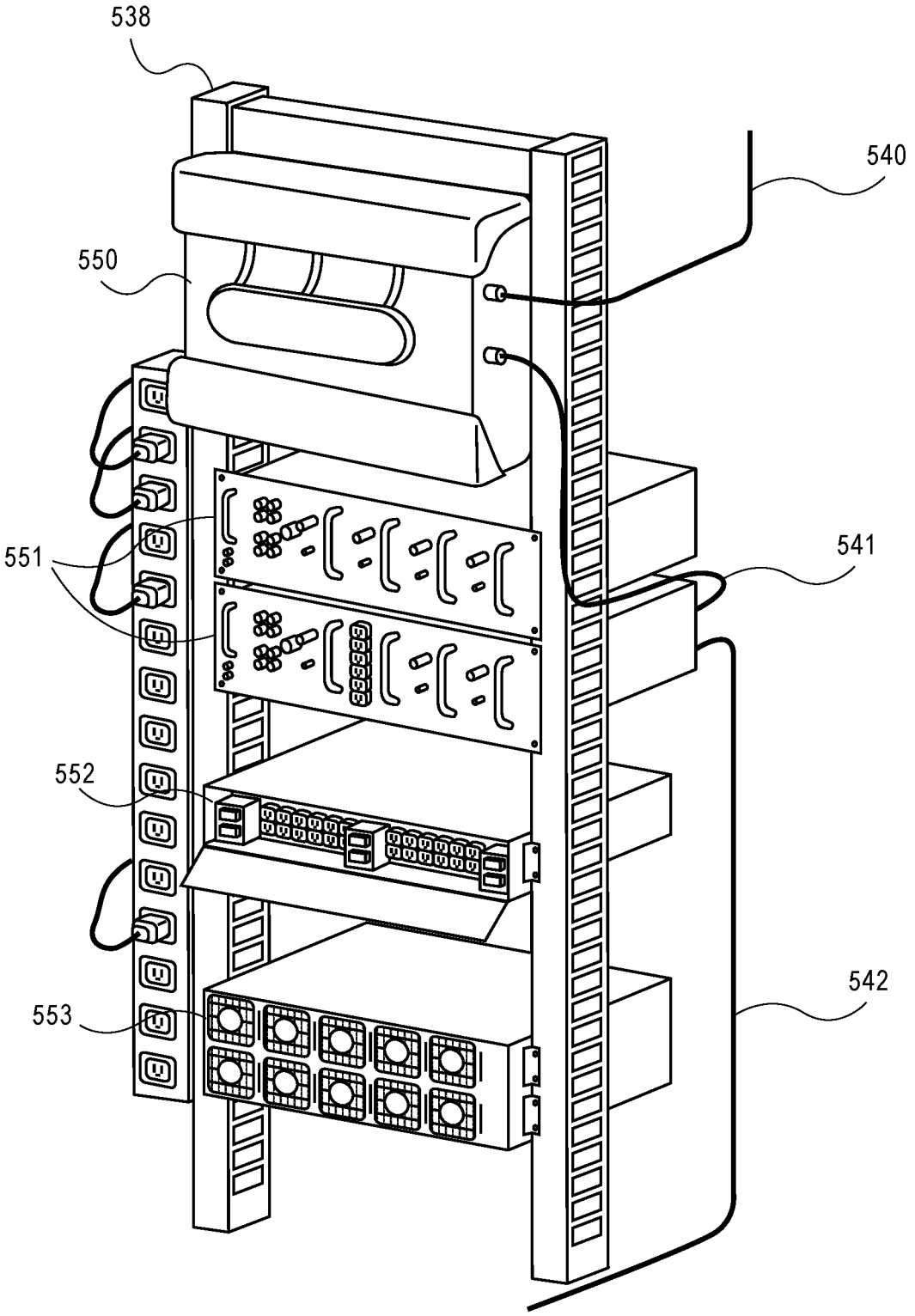
FIG. 5 illustrates of a central processing rack in accordance with an embodiment.

FIG. 5 illustrates of a central processing rack 538 in accordance with an embodiment. Fiber optic cable 540 extends from optical master unit (OMU) 550 to the DAS field (of indoor antennae). Bi-directional amplifier (BDA) 551 is connected to OMU 550 by fire resistant coax cable 541. Fire resistant coax cable 542 connects BDA 551 to the roof antenna. Uninterruptable power supply (UPS) 552 maintains battery power when power is cut. Power supply 553 supplies electricity during normal, day-to-day operation.

Figure 6:
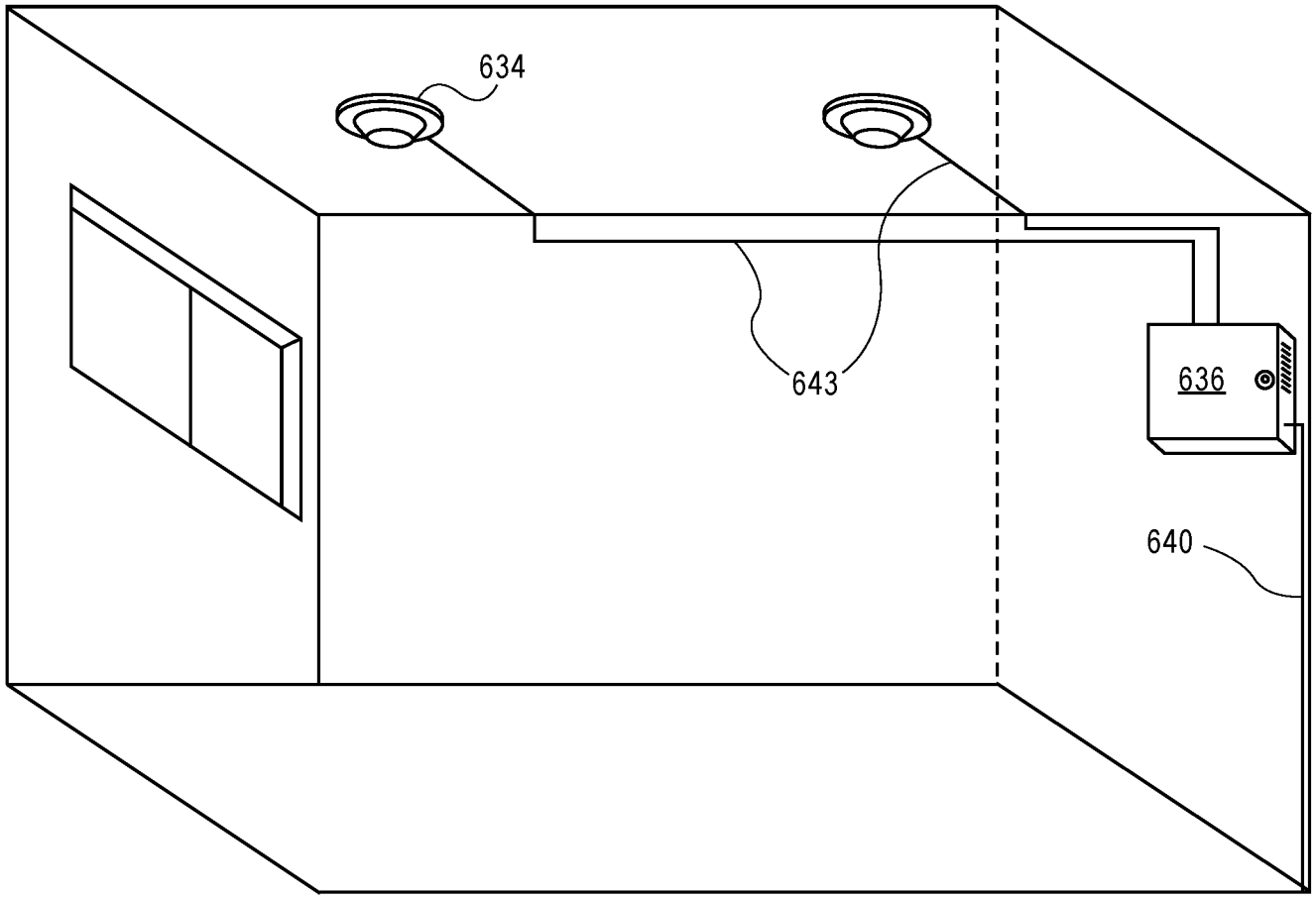
FIG. 6 illustrates coax cables connecting distributed antennas to an antenna tap in accordance with an embodiment.

FIG. 6 illustrates fire resistant coax cables connecting distributed antennas to an antenna tap in accordance with an embodiment. Note that the cable may run on the ceiling where the heat may be most intense during a fire. They may be within a false ceiling. Indoor antennae 634 are connected with optical splitter 636 via fire resistant coax cables 643. Fiber optic cable 640 connects optical splitter 636 with the head-end unit.

As will be apparent to one of skill in the art, embodiments of the fire resistant coax cable can be used in different configurations of the DAS field, such as those with no fiber optic cables or where the top floor of a building houses the bi-directional amplifier. The fire resistant coax cable can be used in non-DAS systems, as in anywhere a coax cable is needed to survive high temperatures. For example, such cables may be used in aircraft and other vehicles, mines and tunnels, power plants, etc.

Testing fire resistant coaxial cable in accordance with embodiments are envisioned. Such testing can include providing a coaxial cable having a center conductor surrounded by a ceramifiable silicone rubber dielectric or a ceramic fiber wrap dielectric, which is surrounded by an outer conductor, which is surrounded by a ceramifiable silicone rubber layer or a ceramic fiber wrap layer, which is surrounded by a low smoke zero halogen jacket. The cable can be subjected to high temperatures, such as 400° C., 425° C., 482° C., 500° C., 750° C., 850° C., 950° C., 1000° C., 1010° C., or as otherwise known in the art. The heat causes ceramification of the ceramifiable silicone rubber layer. The ceramic fiber wrap can withstand the heat. The heat may burn at least a portion of the jacket from the cable.

In order to test the cable, one can pass an electric voltage or current signal through the coaxial cable during or after the ceramifying and the burning. The cable can be tested up to and including destruction.

Further Descriptions

Figure 7A:
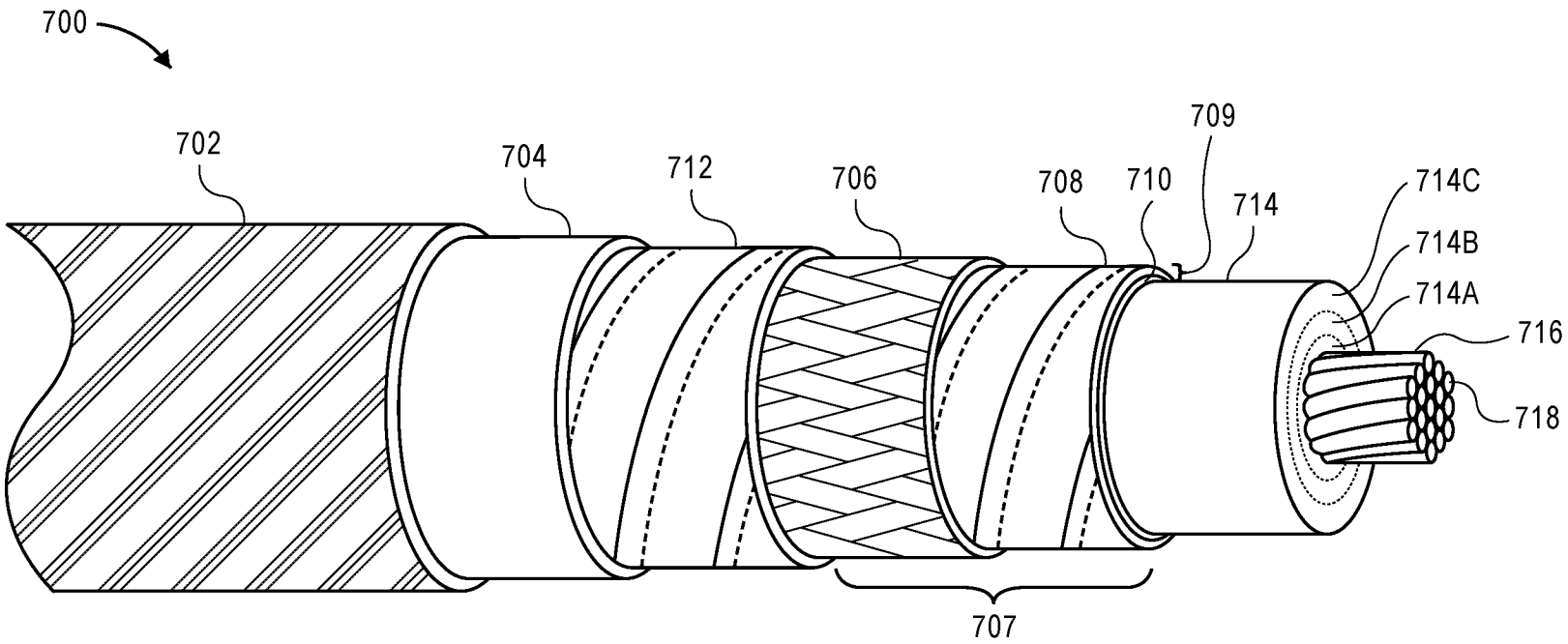
FIG. 7A is a cut-away perspective view of a coaxial cable in accordance with an embodiment.
Figure 7B:
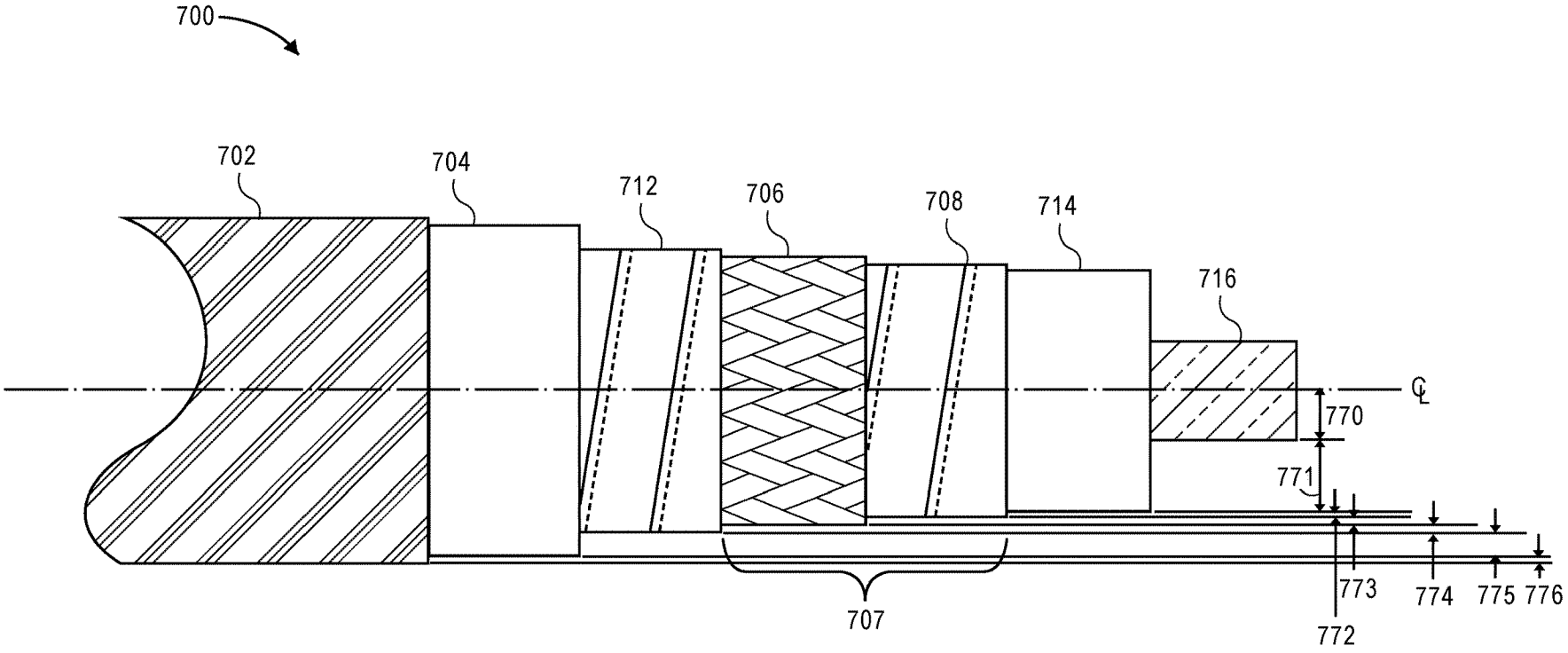
FIG. 7B is a cut-away side view of the coaxial cable of FIG. 7A.
Figure 7C:
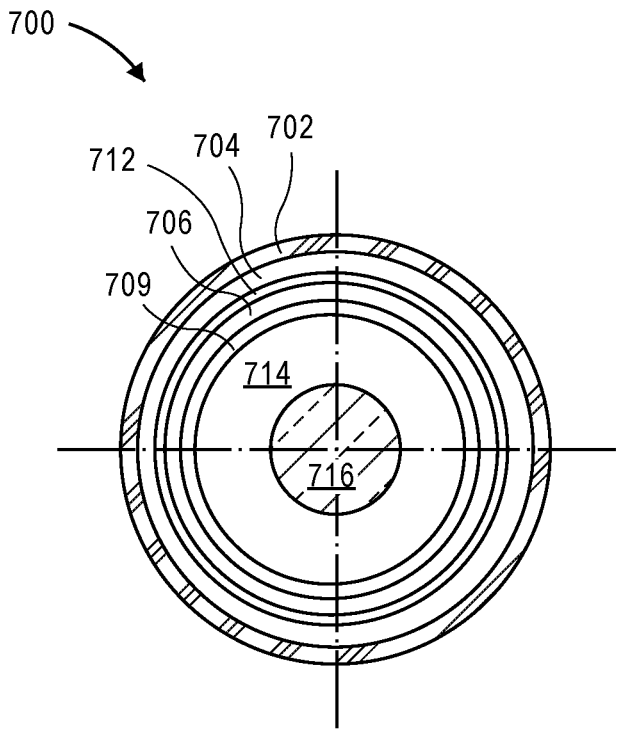
FIG. 7C is a cross section of the coaxial cable of FIG. 7A.

FIGS. 7A-7C illustrate a coaxial cable with a multiple ceramifiable silicone layer dielectric between the center and outer conductors. Coax cable 700 can be run in buildings between DAS equipment and meet applicable fire codes.

Exemplary center conductor 716 includes nineteen strands of nickel plated copper wires 718. the wires are bundled and twisted together.

Surrounding the center conductor are three distinct layers of ceramifiable silicone rubber 714A, 714B, and 714C. Although the layers sit right on top of each other, they are distinguished in that they have been at least partially cured independently. In a fully manufactured cable, this can be determined by assessing the amount of cross linking that has occurred. At the interface between layers there is a drop in the amount of cross linking of polymer chains. There may be a readily noticeable interface between layers that does not require machinery to detect. The layers may peel differently when the cable is dissected. Yet to an electromagnetic field traveling along the cable, the three layers 714A, 714B, and 714C comprise a single ceramifiable silicone rubber dielectric 714.

In some embodiments, a thin, non-ceramifiable silicone rubber layer, such as a separate polymer, is layered between the ceramifiable silicone rubber layers. The separate polymer separates the layers while minimally affecting electric permittivity of the dielectric. Unlike the ceramifiable silicone dielectric, the separate polymer layer may burn off in a fire.

Some embodiments have only two layers. Having only two layers of ceramifiable silicone rubber simplifies manufacturing and may result in a more geometrically and electrically consistent dielectric than three layers. Although not explicitly shown in the figure, two-layer embodiments are envisioned, among others. For example, four, five, or more layers of ceramifiable silicone rubber may be suitable for other cables. Some cables may require more spacing between the center and outer conductor, and thus more dielectric, in order to achieve a desired impedance. Or, cables may use less viscous product mixtures of silicone rubber that have different stabilities and cure rates, requiring more, thinner layers.

Immediately encasing ceramifiable silicone rubber dielectric 714 is metalized MYLAR® tape 709. Plastic tape 709 is wrapped at a 25% nominal lap with the MYLAR® plastic film side down and metal (copper) side up. Metalized tape 709 includes plastic flexible film 710 and metal foil 708. Plastic flexible film 710 directly touches ceramifiable silicone rubber dielectric 714.

Immediately touching metal foil 708 is metal braid 706. A 36 AWG tin plated copper braid with 85% minimum coverage is shown in the exemplary embodiment. Naturally, other embodiments employ other braidings.

Metal braid 706 and metal foil 708 (of MYLAR® tape 709) jointly form outer conductor 707. That is, the continuous electrical connection of metal braid 706 and metal foil 708 form a single conductor that is coaxial with inner center conductor 716.

The next layer is a plastic sheath 712 of MYLAR® flexible plastic tape. This layer has a nominal lap of 10% and is non metalized. An advantage of this layer is that it prevents the next layer from soaking or embedding into relatively porous metal braid 706.

A layer of extruded ceramifiable silicone rubber covers plastic sheath 712 and forms refractory insulating jacket 704. Under fire conditions while other plastic layers burn off, ceramifiable silicone rubber refractory insulating jacket 704 ceramifies and maintains insulation between outer conductor 707 and any conduit, ductwork, or other metal against which cable 700 rests.

In some embodiments, refractory insulating jacket 704 is made of a ceramic fiber wrap. It can include refractory aluminoborosilicate, aluminosilica, or alumina. Either ceramifiable silicone rubber-based or ceramic fiber wrap-based refractory insulating jacket 704 is an inner jacket, surrounded by an outer jacket.

Outer jacket 702 surrounds refractory insulating (inner) jacket 704. Outer jacket 702 is a low smoke zero halogen (LSZH), cross-link irradiated polyolefin. It protects the pliable silicone rubber of the inner jacket or tear-able ceramic fiber wrap inner jacket. Sliding more easily through walls and conduits, the outer jacket is more compatible with existing tools and methods for pulling, pushing, and otherwise installing cable.

FIG. 7B diagrams radial or layer thickness dimensions. Central conductor radius 770 is the radius (i.e., half the diameter) of center conductor 716. Dielectric layer thickness 771 is the thickness of the combined layers 714A, 714B, and 714C of ceramifiable silicone rubber dielectric 714. Metalized tape thickness 772 is the thickness of copper MYLAR® tape 709. Metal braid thickness 773 is the thickness of metal braid 706. Plastic sheath thickness 774 is the thickness of separator plastic sheath 712. Refractory insulating jacket thickness 775 is the thickness of refractory insulating (inner) jacket 704. And outer jacket thickness 776 is the thickness of outer jacket 702.

Cable 700 can be made in standard 50Ω or 75Ω cable impedances or other impedances. Tables 5 and 6 tabulate values and practical tolerances for thicknesses 770, 771, 772, 773, 774, 775, and 776 of the layers.

TABLE 5

Ceramifiable Silicone Dielectric, Braided 50 Ω Coax Cable (Drawing No. S-8311-1990)

| Structure Type | Outer Diameter | Layer Thickness | Material |
|---|---|---|---|
| Center conductor | 4.70 mm ± 0.18 mm (0.185 in. ± 0.007 in.) | 4.7 mm diameter | nickel plated copper, 19 × 0.0372" |
| Dielectric | 18.03 mm ± 0.38 mm (0.710 in. ± 0.015 in.) | 6.67 mm | ceramic forming silicone rubber, total wall thickness 0.297" |
| Outer conductor #1 foil | 18.80 mm ± 0.18 mm (0.740 in. ± 0.007 in.) | 0.38 mm | copper MYLAR ® flexible film tape (25% nominal lap, copper side up) |
| Outer conductor #2 braid | 19.30 mm ± 0.25 mm (0.760 in. ± 0.010 in.) | 0.25 mm | 36 AWG tin plated copper braid, 85% min. coverage |
| Separator tape | 20.83 mm (0.820 in.) | 0.76 mm | MYLAR ® flexible film 10% nominal lap |
| Inner jacket | 23.88 mm ± 0.25 mm (0.940 in. ± 0.010 in.) | 1.52 mm | ceramic forming silicone rubber, 0.08" wall |
| Outer jacket | 27.31 mm ± 0.64 mm (1.075 in. ± 0.025 in.) | 1.71 mm | low smoke zero halogen (LSZH), cross-link irradiated polyolefin, 0.062" wall |

TABLE 6

Ceramifiable Silicone Dielectric, Braided 75 Ω Coax Cable (Drawing No. S-8311-2476)

| Structure Type | Outer Diameter | Layer Thickness | Material |
|---|---|---|---|
| Center conductor | 4.70 mm ± 0.18 mm (0.185 in. ± 0.007 in.) | 4.7 mm diameter | nickel plated copper, 19 × 0.0372" |
| Dielectric | 41.15 mm ± 0.38 mm (1.620 in. ± 0.015 in.) | 18.2 mm | ceramic forming silicone rubber, total wall thickness 0.297" |
| Outer conductor #1 foil | 42.16 mm ± 0.18 mm (1.660 in. ± 0.007 in.) | 0.51 mm | copper MYLAR ® flexible film tape (25% nominal lap, copper side up) |
| Outer conductor #2 braid | 42.93 mm ± 0.25 mm (1.690 in. ± 0.010 in.) | 0.38 mm | 36 AWG tin plated copper braid, 85% min. coverage |
| Separator tape | 43.94 mm (1.730 in.) | 0.51 mm | MYLAR ® flexible film 10% nominal lap |
| Inner jacket | 46.99 mm ± 0.25 mm (1.850 in. ± 0.010 in.) | 1.52 mm | ceramic forming silicone rubber, 0.08" wall |
| Outer jacket | 50.29 mm ± 0.64 mm (1.985 in. ± 0.025 in.) | 1.65 mm | low smoke zero halogen (LSZH), |

TABLE 6-continued

Ceramifiable Silicone Dielectric, Braided 75 Ω Coax Cable (Drawing No. S-8311-2476)

| Structure Type | Outer Diameter | Layer Thickness | Material |
|---|---|---|---|
| | | | cross-link irradiated polyolefin, 0.062" wall |

Figure 8A:
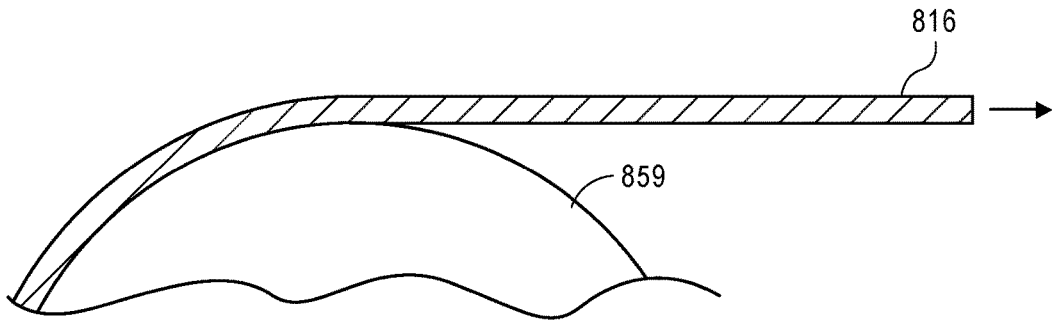
FIG. 8A illustrates a bare conductor being pulled from a spool as part of a manufacturing method in accordance with an embodiment.
Figure 8B:
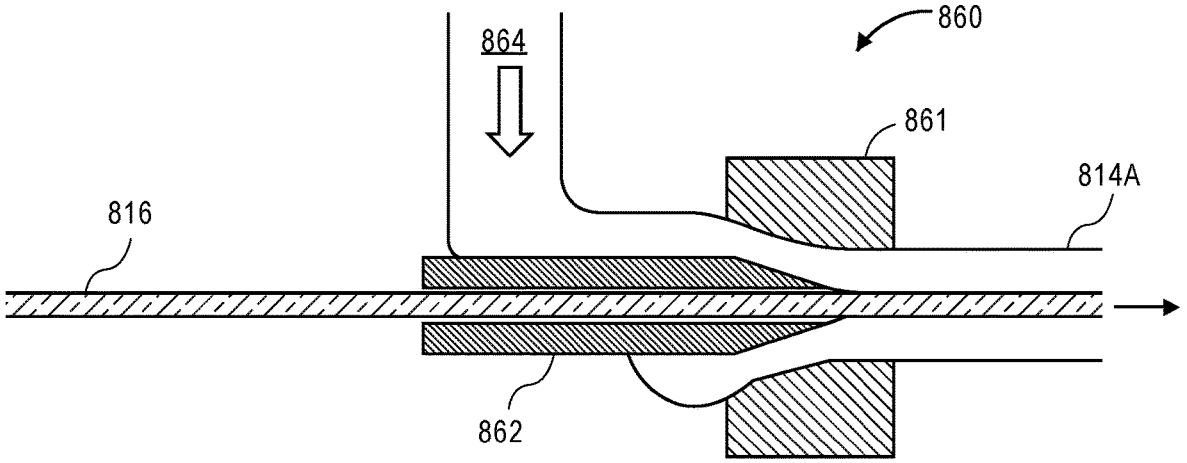
FIG. 8B illustrates extruding a 1st layer of uncured ceramifiable silicone rubber dielectric over the bare conductor as part of the manufacturing method of FIG. 8A.
Figure 8C:
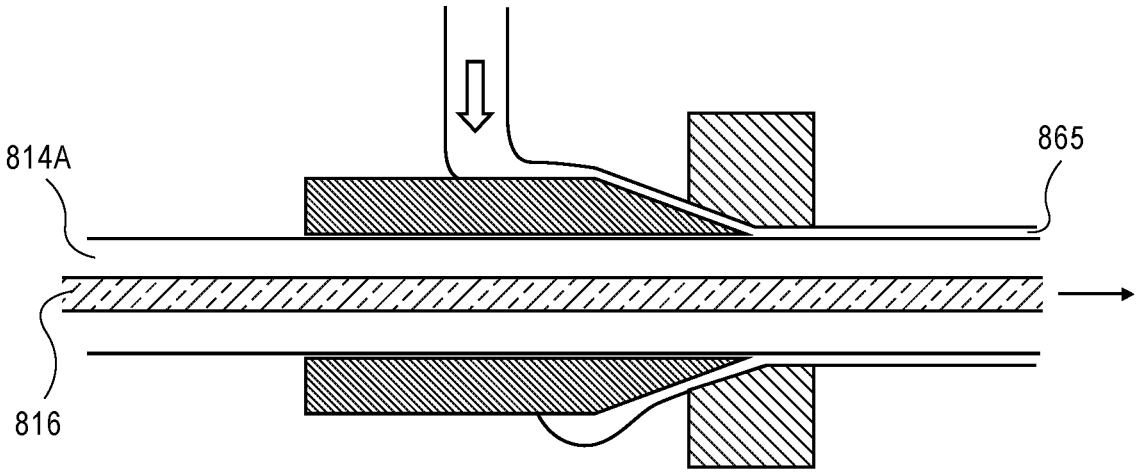
FIG. 8C illustrates coating the 1st layer of uncured ceramifiable silicone rubber dielectric of FIG. 8B with a 1st sheath mold.
Figure 8D:
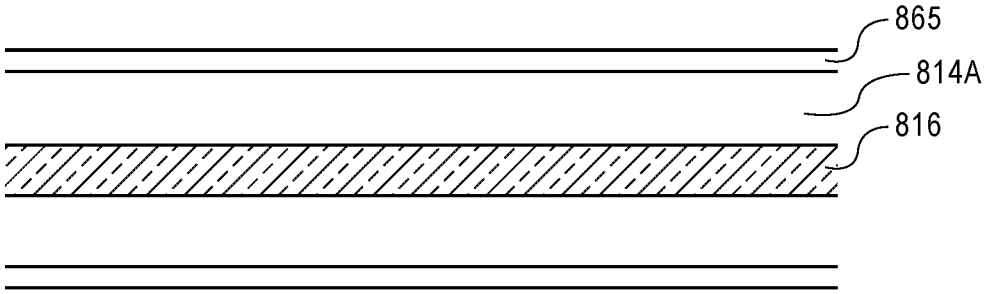
FIG. 8D illustrates curing the 1st layer of ceramifiable silicone rubber dielectric within the 1st sheath mold of FIG. 8C.
Figure 8E:
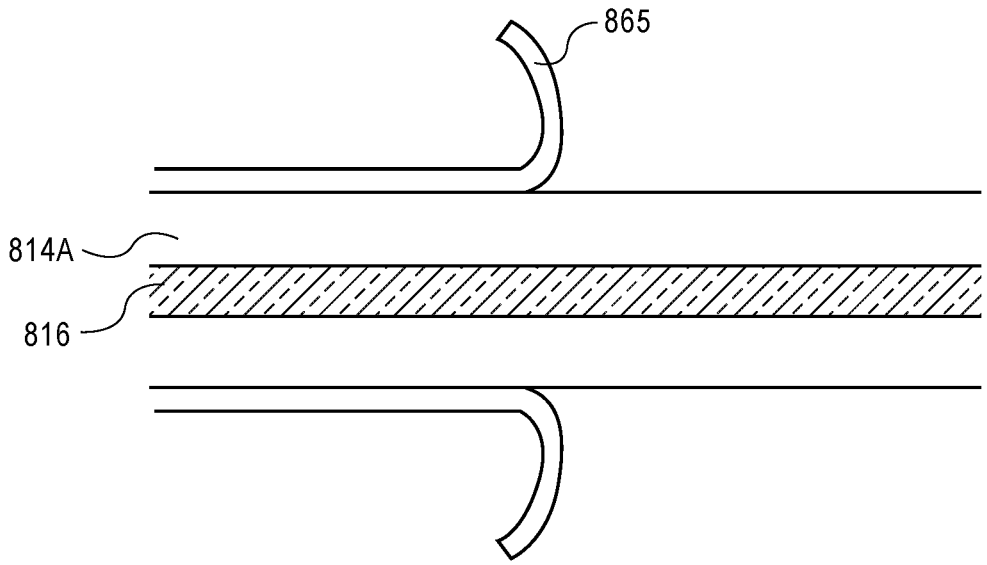
FIG. 8E illustrates stripping the 1st sheath mold of FIG. 8D.
Figure 8F:
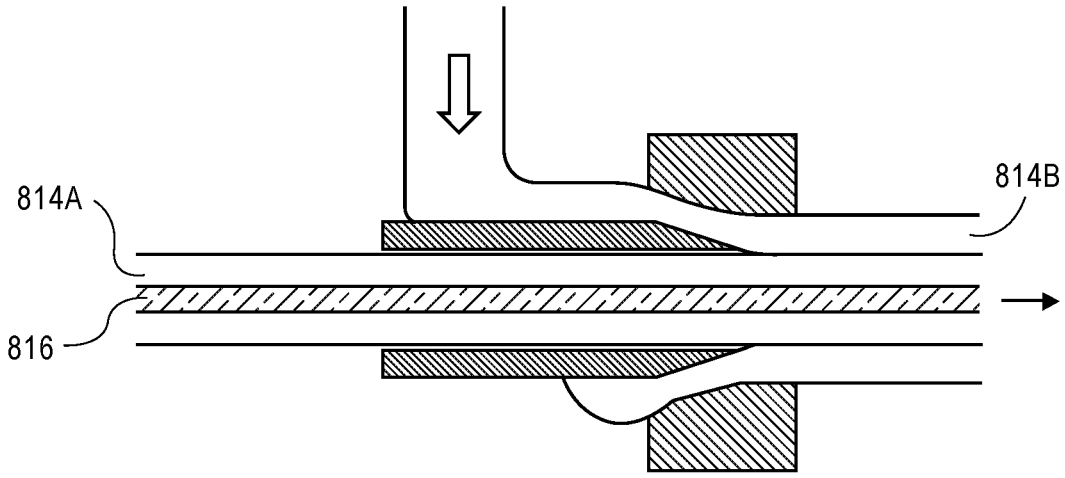
FIG. 8F illustrates extruding a 2nd layer of uncured ceramifiable silicone rubber dielectric over the 1st layer of ceramifiable silicone rubber dielectric cured in FIG. 8D.
Figure 8G:
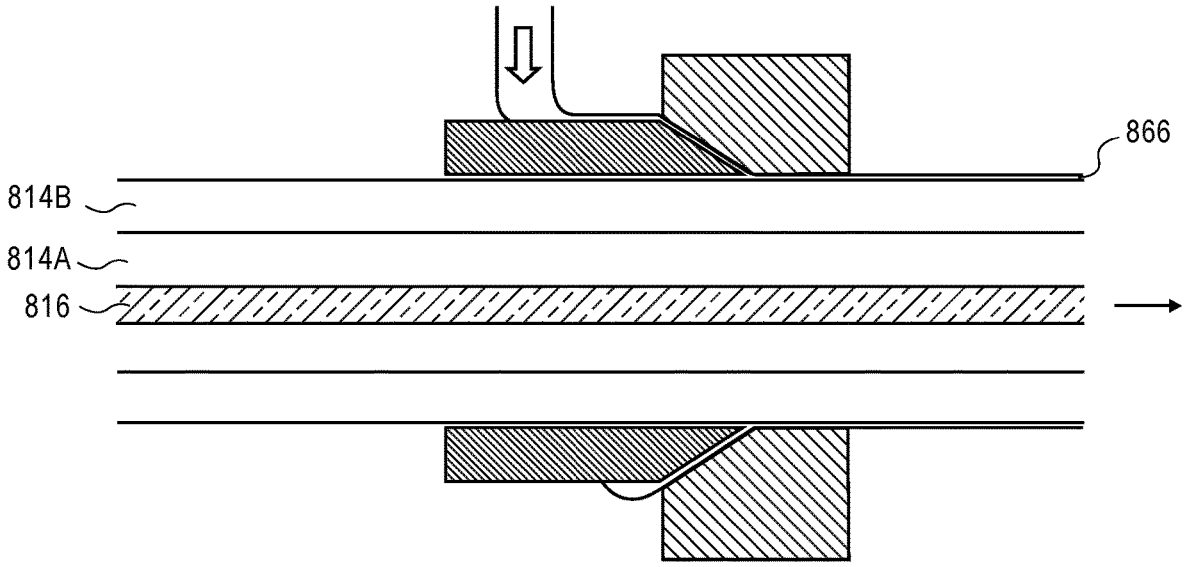
FIG. 8G illustrates coating the uncured 2nd layer of ceramifiable silicone rubber dielectric of FIG. 8F with a 2nd sheath mold.
Figure 8H:
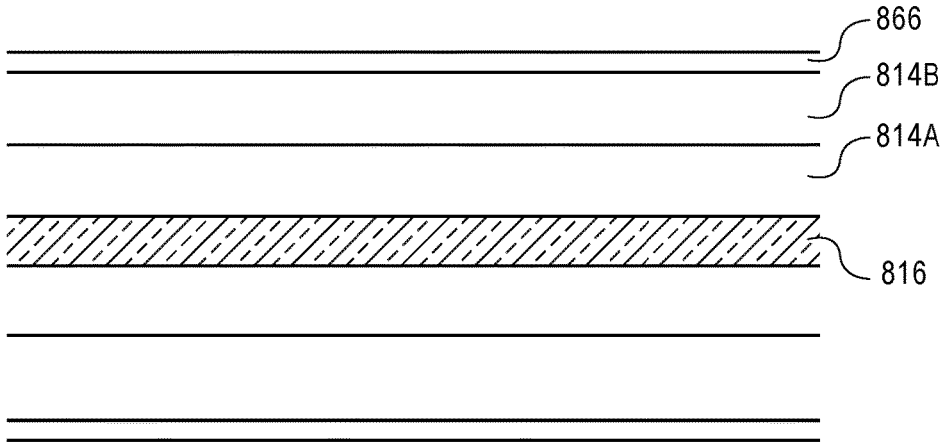
FIG. 8H illustrates curing the 2nd layer of ceramifiable silicone rubber dielectric within the 2nd sheath mold of FIG. 8G.
Figure 8I:
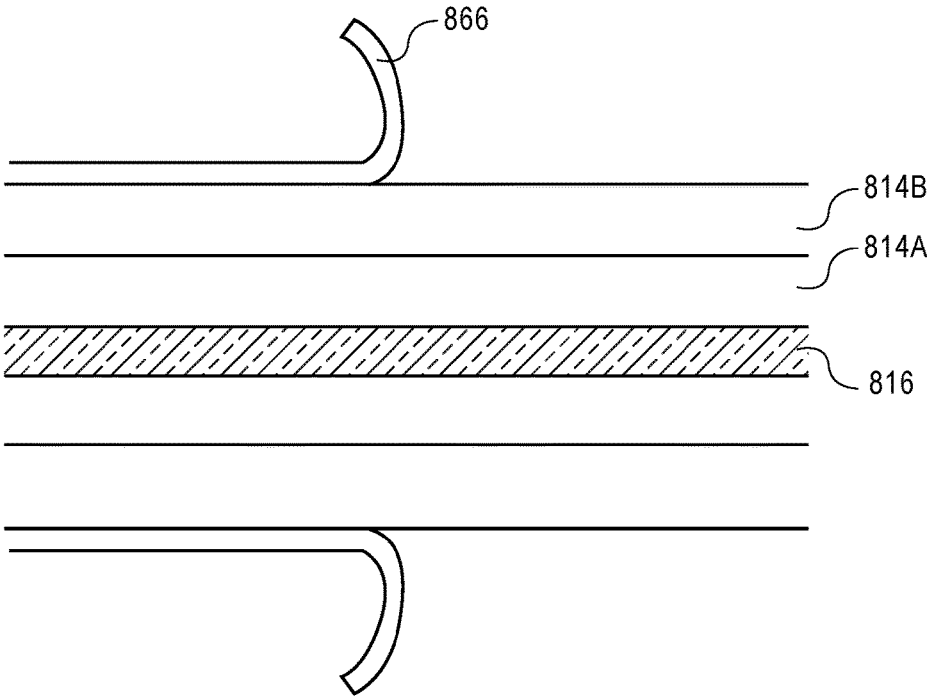
FIG. 8I illustrates stripping the 2nd sheath mold of FIG. 8G.
Figure 8J:
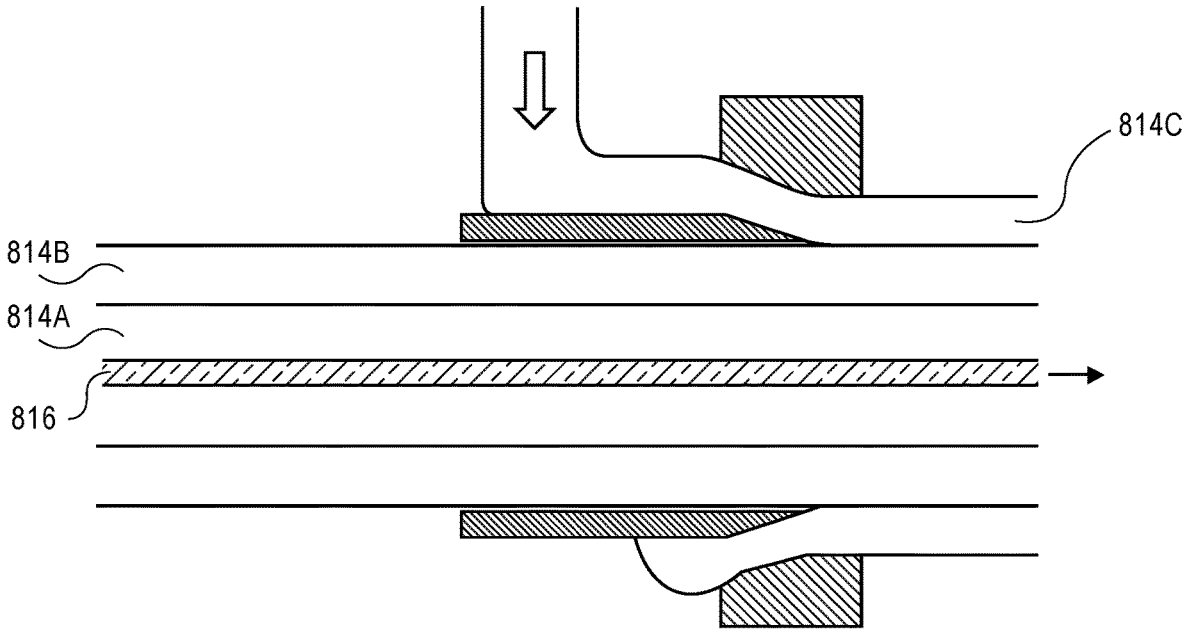
FIG. 8J illustrates extruding a 3rd layer of uncured ceramifiable silicone rubber dielectric over the 2nd layer of ceramifiable silicone rubber dielectric cured in FIG. 8H.
Figure 8K:
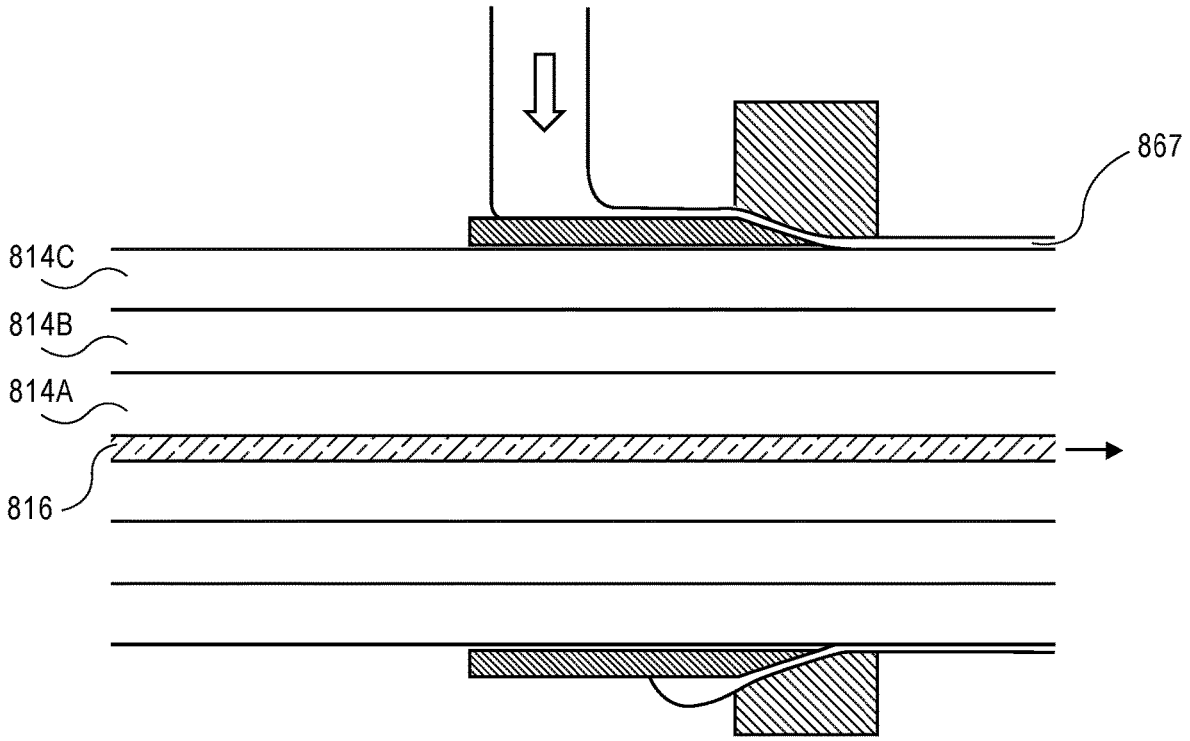
FIG. 8K illustrates coating the uncured 3rd layer of ceramifiable silicone rubber dielectric of FIG. 8J with a 3rd sheath mold.
Figure 8L:
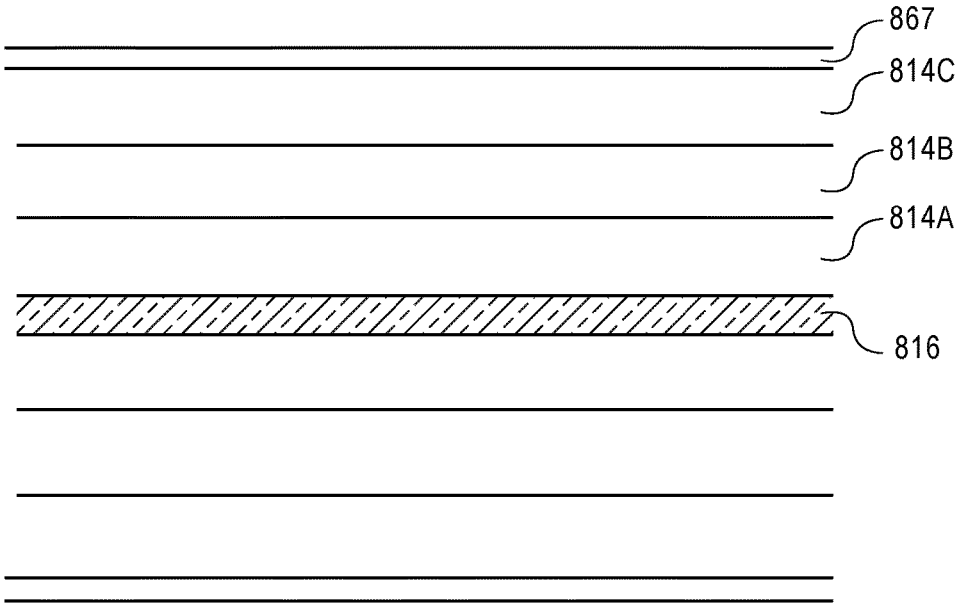
FIG. 8L illustrates curing the 3rd layer of ceramifiable silicone rubber dielectric within the 3rd sheath mold of FIG. 8K.
Figure 8M:
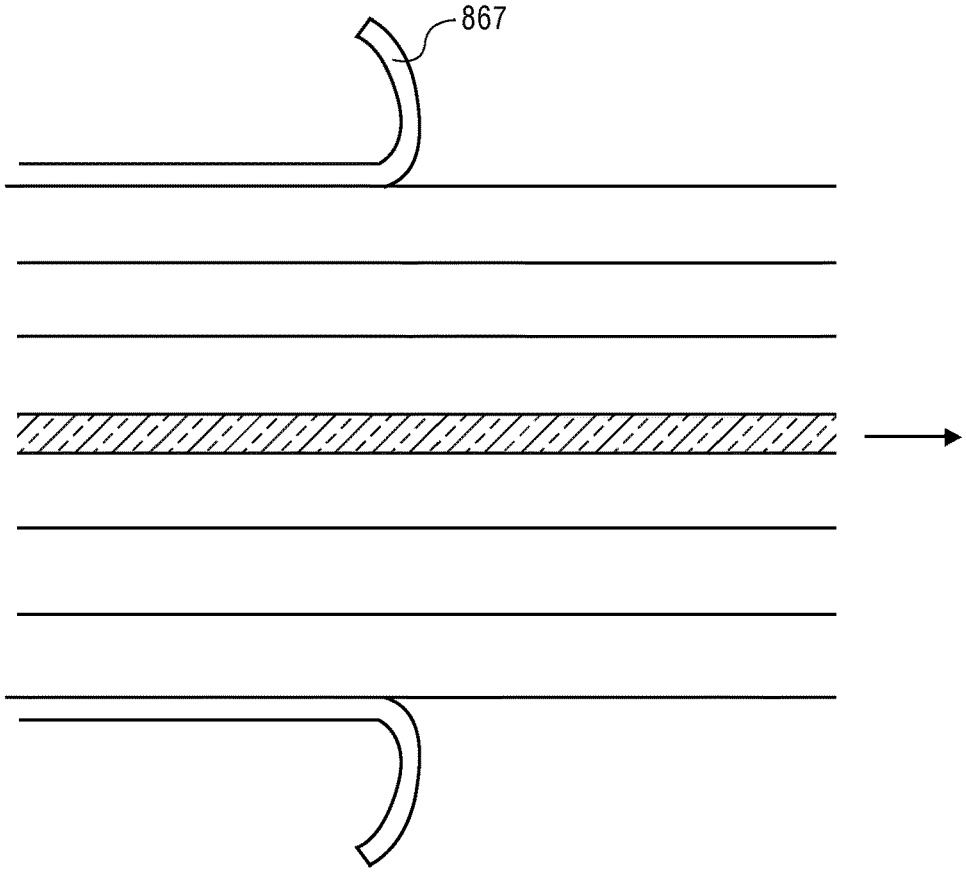
FIG. 8M illustrates stripping the 3rd sheath mold of FIG. 8K.
Figure 8N:
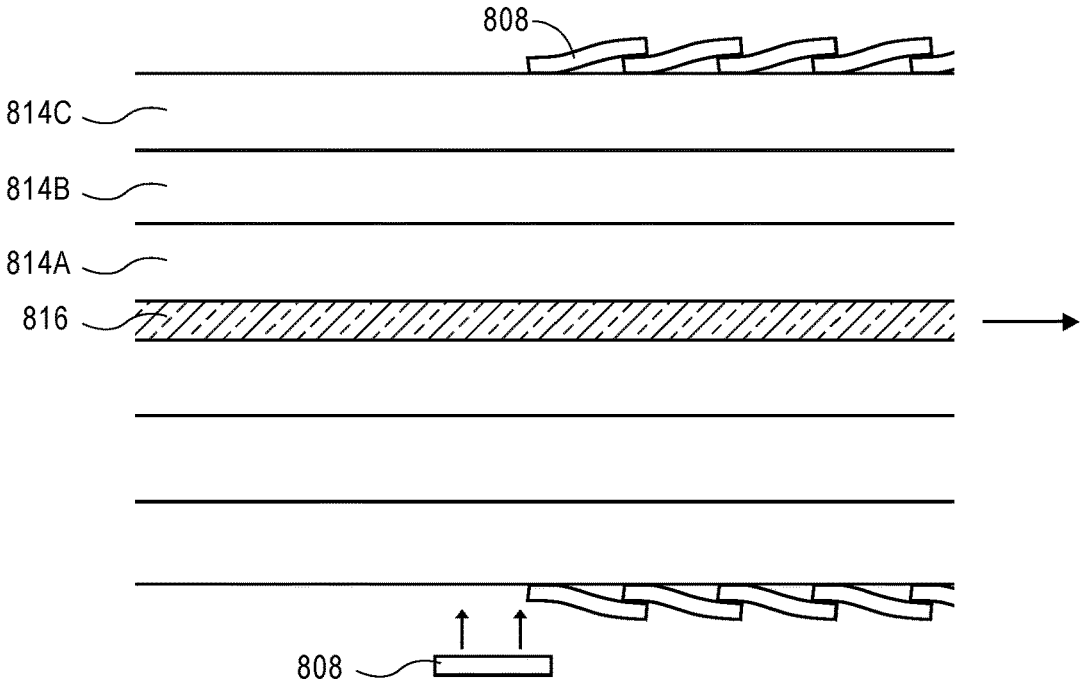
FIG. 8N illustrates wrapping a plastic film metalized with metal foil around the 3rd layer of ceramifiable silicone rubber dielectric cured in FIG. 8L.
Figure 8O:
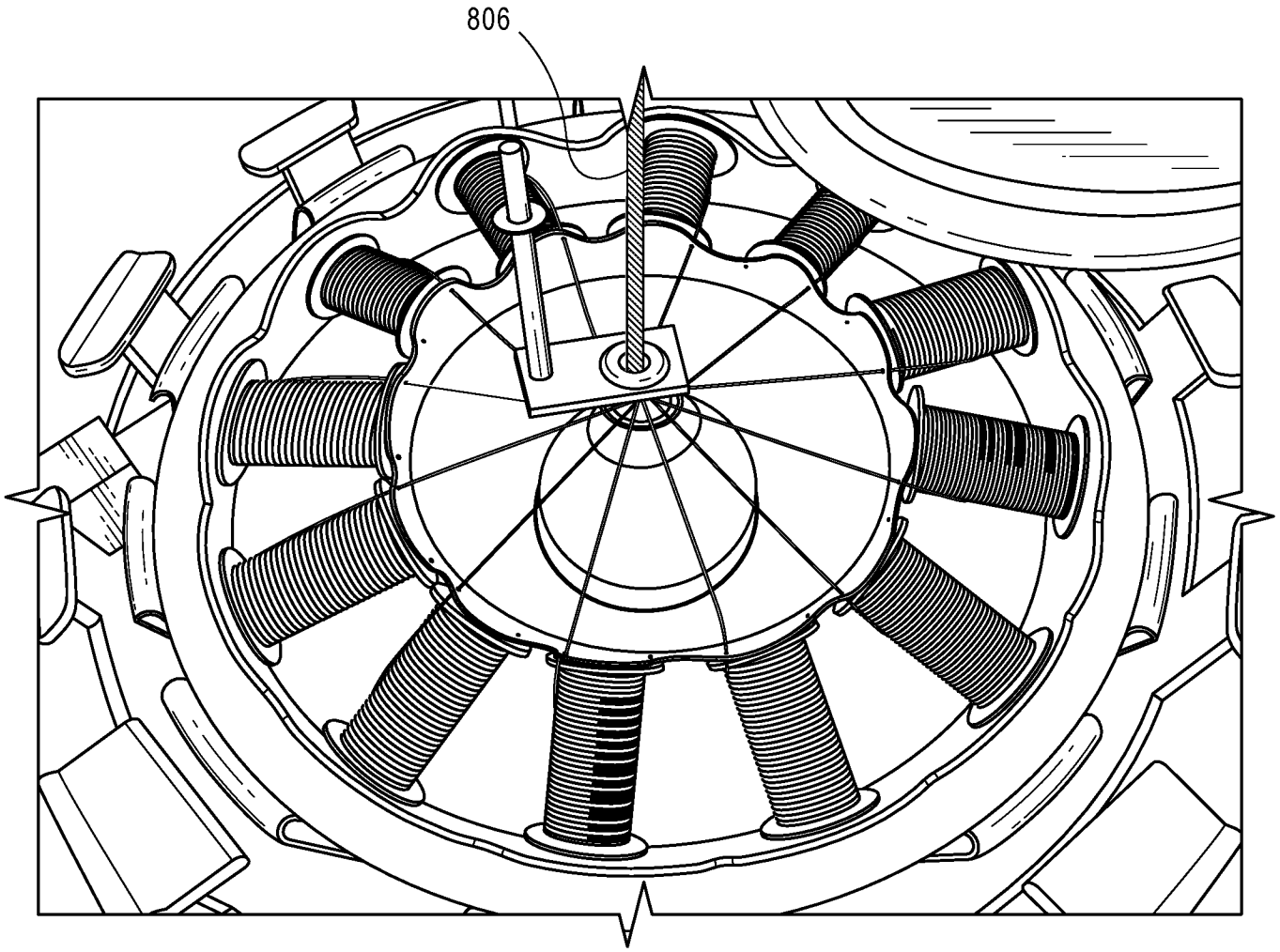
FIG. 8O illustrates encasing the 3rd layer of ceramifiable silicone rubber dielectric of FIG. 8L by wrapping the metalized plastic film of FIG. 8N with metal braiding.
Figure 8P:
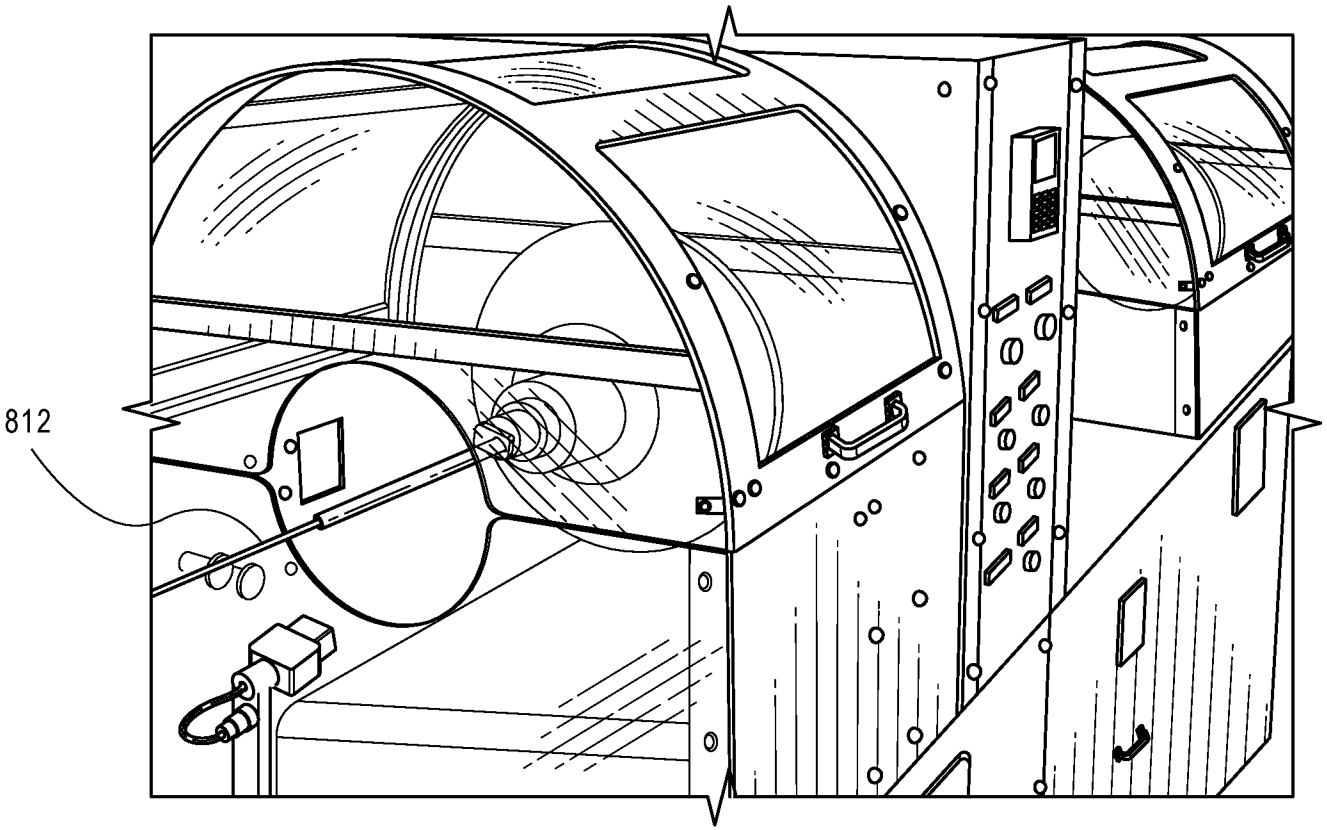
FIG. 8P illustrates taping a plastic sheath around the metal braiding of FIG. 8O.

FIGS. 8A-8P illustrate a manufacturing process for constructing cable with ceramifiable silicone rubber layers in accordance with an embodiment.

FIG. 8A illustrates bare conductor 816 being pulled from spool 859. Bare conductor 816 will serve as a central conductor in the final cable.

FIG. 8B illustrates extruding a 1st layer of uncured ceramifiable silicone rubber 864 over bare conductor 816. Other parts of extruder 860 are not shown in the figure for clarity. Bare cable 816 comes in from the left of the figure into wire guide 862. Uncured silicone rubber 864 flows into the extruder and between wire guide 862 and extrusion form 861. Layer 814A of uncured silicone rubber dielectric sticks to the cable and begins curing, albeit curing at too slow of a rate that it will reliably stay in place around the thin central conductor for long.

FIG. 8C illustrates coating the 1st layer of uncured ceramifiable silicone rubber dielectric 814A with a 1st sheath mold 865. The 1st sheath mold is formed from a fast drying/curing polymer that is applied through another extruder. That is, inner conductor 816 with 1st layer of uncured ceramifiable silicone rubber is fed through the entrance of a wire guide on a second extruder. Uncured polymer is injected between the wire guide and extrusion form and extruded in a thin layer over the ceramifiable silicone rubber. The polymer cures relatively quickly into 1st sheath mold 865.

FIG. 8D illustrates curing the 1st layer of ceramifiable silicone rubber dielectric 814 within 1st sheath mold 816. The sheath mold offers a large bearing area to support the ceramifiable silicone rubber. If small regions of ceramifiable silicone rubber have too little cohesiveness to keep from slumping, they will bear against the bottom of the sheath mold that is held in place by surrounding ceramifiable silicone rubber. The sheath mold effectively holds the uncured silicone in place better than it can hold itself. Curing of the thermoset silicone blend can be accomplished by baking the inchoate cable in an oven.

This can be done by carefully coiling the sheath mold coated 1st layer over a large (e.g., 1 meter diameter) cable spool without pulling it excessively. The cable spool can be like that of cable spool 859. The cable spool with the uncured cable can be transported by forklift or otherwise moved into a large industrial oven. The oven can heat the air surrounding the cable to 150° C., 200° C., 250° C., 300° C., 350° C., 400° C., 450° C., 500° C., or other temperatures in a range above room temperature (25° C.) and below ceramification temperatures (e.g., 425° C., 482° C., 600° C., 1010° C.) of the ceramifiable silicone rubber.

In order to avoid thermally shocking the ceramifiable silicone rubber, the temperature of the oven can be warmed or cooled by no more than 1° C., 2° C., 3° C., 4° C., or 5° C. per minute or other temperature change limits.

Baking can last several hours. It has been found to effectively cure the ceramifiable silicone rubber compound when baked overnight, after 24 hours, or after 48 hours. After baking, the oven is cooled and the cable spool removed for the next steps.

FIG. 8E illustrates stripping 1st sheath mold 865 from cured ceramifiable silicone rubber layer 814A. This can be accomplished by shearing, cutting, peeling, dissolving, or other stripping methods. The cable with the 1st layer of partially or fully ceramifiable silicone rubber can then be run through another extrusion machine and mold extruder for subsequent layers.

FIGS. 8F-8M illustrates extruding a 2nd layer 814B and 3rd layer 814C of ceramifiable silicone rubber dielectric with related molds 866 and 867. As before, curing and mold stripping steps are in between.

One may stop at two layers of ceramifiable silicone rubber, or one may continue with four or more layers to build up thicknesses as needed. For any given dielectric thickness, an advantage of extruding only two layers of ceramifiable silicone rubber is that it simplifies manufacturing. Yet an advantage of more, thinner layers is that curing, and thus centeredness of the center conductor within the dielectric, may be more assured with thinner layers.

FIG. 8N illustrates wrapping a plastic film 808 metalized with metal foil around the ceramifiable silicone rubber dielectric of layers 814A, 814B, and 814C. Metalized plastic film 808 is wound around the layers, overlapping itself by a fraction on every turn. The metal foil side of the metalized plastic film faces outward.

FIG. 8O illustrates braiding a metal braid 806 around the ceramifiable silicone rubber dielectric and metalized plastic film. The metal braiding makes a good electrical connection with the metal foil of the metalized plastic film 808 below and forms a continuous coaxial conductor. The metal foil and metal braid 806 encases the ceramifiable silicone rubber dielectric with an outer conductor.

FIG. 8P illustrates taping plastic sheath 812 around the metal braid. This prevents the next layer from embedding into the metal braid.

A further step includes extruding a ceramifiable silicone rubber layer over plastic sheath 812 in order to insulate the outer conductor with a refractory insulating jacket. This is similar to the step shown in FIG. 8B. No sheath mold may be needed, as this layer of ceramifiable silicone rubber may be relatively thin and/or well supported by the relatively large radius layers below.

Figure 8Q:
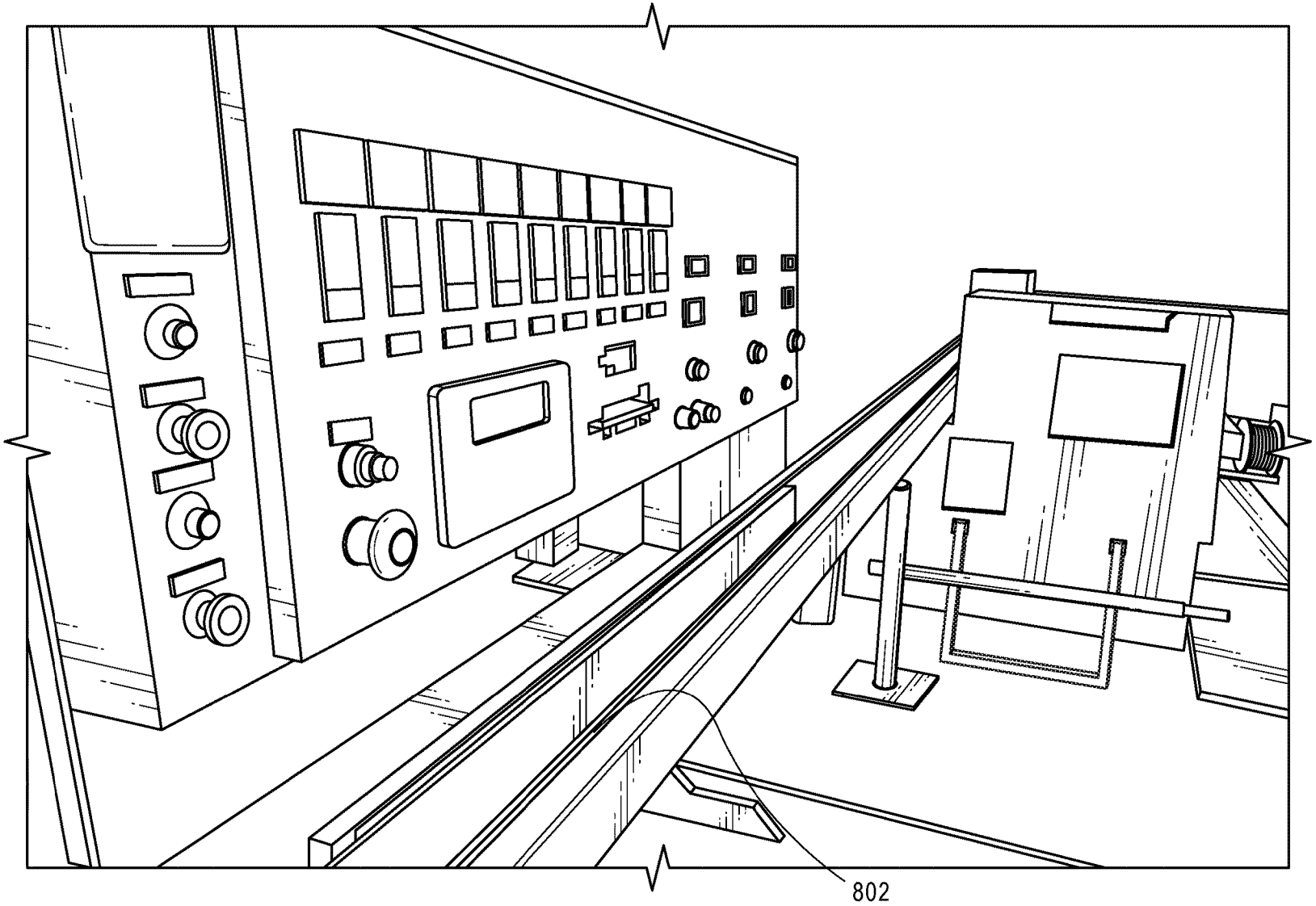
FIG. 8Q illustrates enclosing a refractory insulating jacket surrounding the cable of FIG. 8P with a low smoke zero halogen (LSZH) outer jacket.

Alternatively, another taping machine can wrap a ceramic fiber inner jacket over the metal braid or plastic sheath 812 in order to insulate the outer conductor with a refractory insulating jacket. This taping is similar to the step shown in FIG. 8N FIG. 8Q illustrates extruding and enclosing the refractory insulating jacket with low smoke zero halogen (LSZH) outer jacket 802. This seals up the cable so that it may be used in common installations alongside other cables and equipment.

Figure 9:
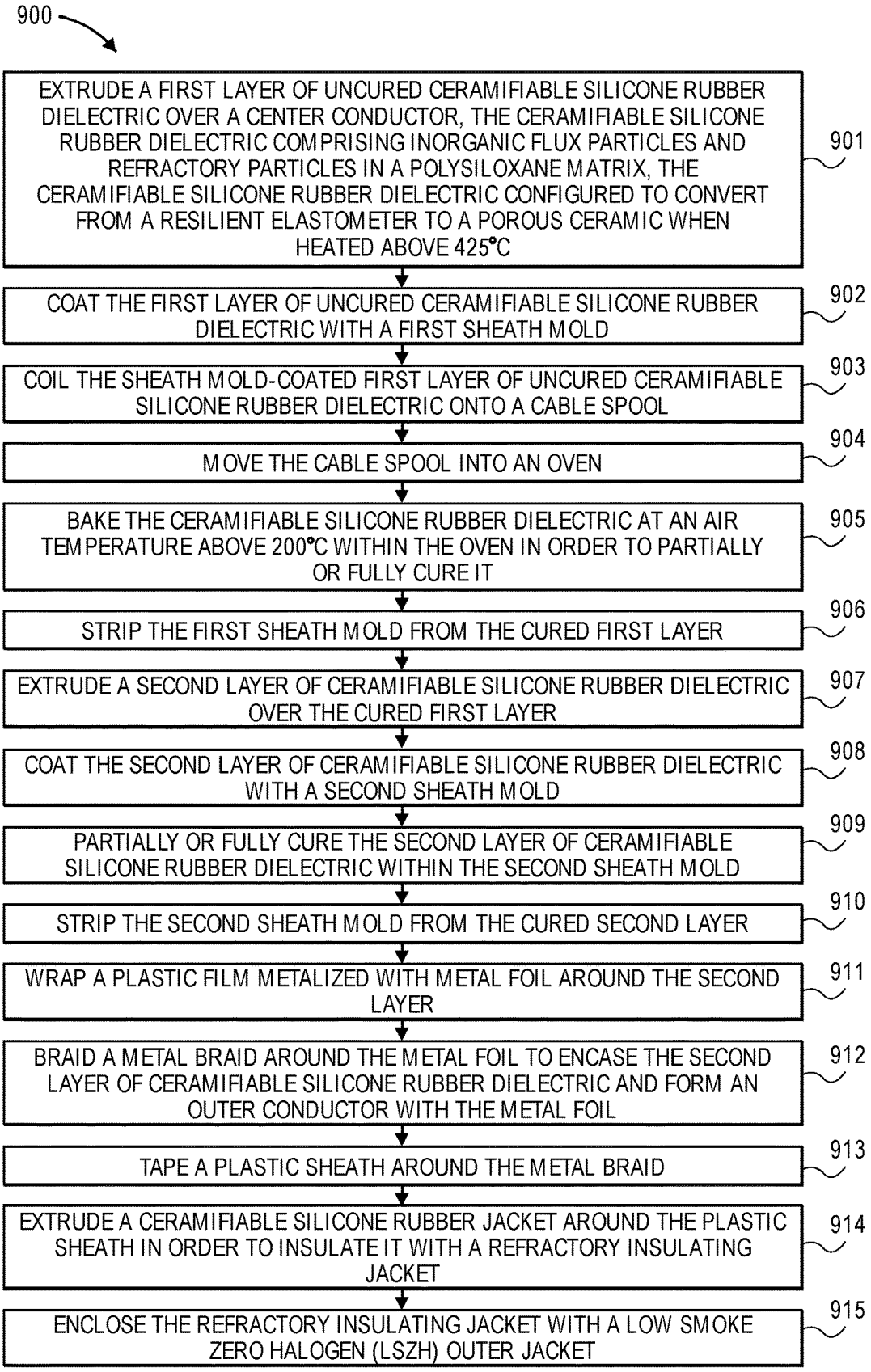
FIG. 9 is a flowchart of a process in accordance with an embodiment.

FIG. 9 is a flowchart of process 900 in accordance with an embodiment. In operation 901, a first layer of uncured ceramifiable silicone rubber dielectric is extruded over a center conductor, the ceramifiable silicone rubber dielectric comprising inorganic flux particles and refractory particles in a polysiloxane matrix, the ceramifiable silicone rubber dielectric configured to convert from a resilient elastomer to a porous ceramic when heated above 425° C. The ceramifiable silicone rubber may simply start to slightly ceramify above 425° C., or it may be fully engulfed in ceramification above that temperature. In operation 902, the first layer of uncured ceramifiable silicone rubber dielectric is coated with a first sheath mold. In operation 903, the sheath mold-coated first layer of uncured ceramifiable silicone rubber dielectric is coiled onto a cable spool. In operation 904, the cable spool is moved into an oven. In operation 905, the ceramifiable silicone rubber dielectric is baked at an air temperature above 200° C. within the oven in order to partially or fully cure it. In operation 906, the first sheath mold is stripped from the cured first layer. In operation 907, a second layer of ceramifiable silicone rubber dielectric is extruded over the cured first layer. In operation 908, the second layer of ceramifiable silicone rubber dielectric is coated with a second sheath mold. In operation 909, the second layer of ceramifiable silicone rubber dielectric is partially or fully cured within the second sheath mold. In operation 910, the second sheath mold is stripped from the cured second layer. In operation 911, a plastic film metalized with metal foil is wrapped around the second layer. In operation 912, a metal braid is braided around the metal foil to encase the second layer of ceramifiable silicone rubber dielectric and form an outer conductor with the metal foil. In operation 913, a plastic sheath is taped around the metal braid. In operation 914, a ceramifiable silicone rubber jacket is extruded around the plastic sheath in order to insulate it with a refractory insulating jacket. In operation 915, the refractory insulating jacket is enclosed with a low smoke zero halogen (LSZH) outer jacket.

Figure 10:
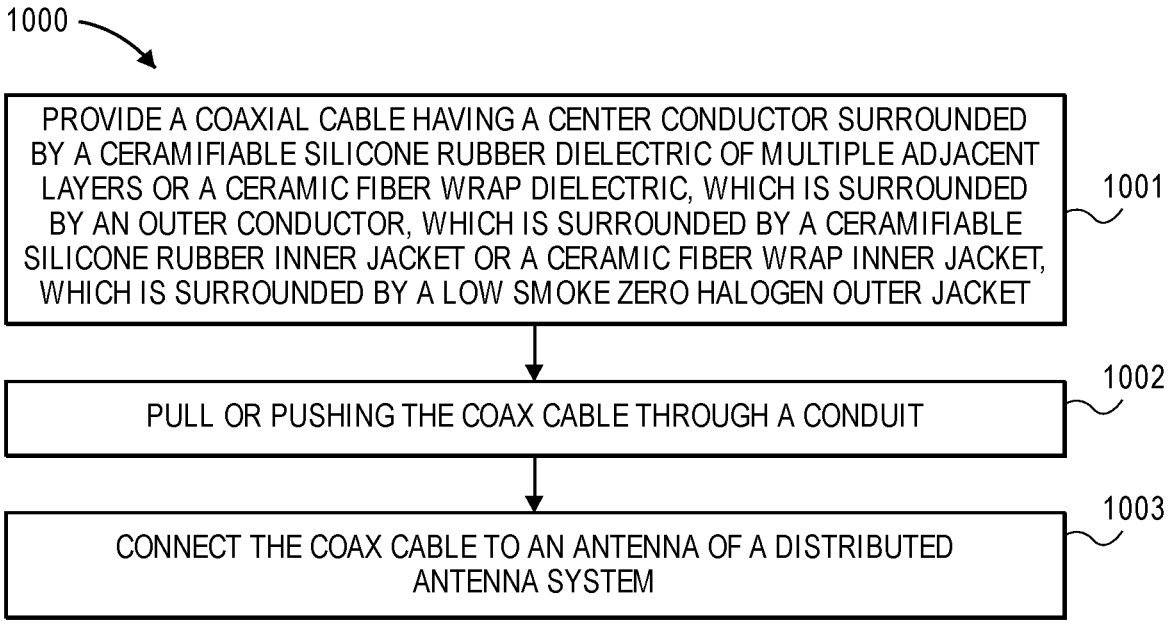
FIG. 10 is a flowchart of a process in accordance with an embodiment.

FIG. 10 is a flowchart of process 1000 in accordance with an embodiment. In operation 1001, a coaxial cable having a center conductor surrounded by a ceramifiable silicone rubber dielectric of multiple adjacent layers or a ceramic fiber wrap dielectric, which is surrounded by an outer conductor, which is surrounded by a ceramifiable silicone rubber inner jacket or a ceramic fiber wrap inner jacket, which is surrounded by a low smoke zero halogen outer jacket, is provided. In operation 1002, the coax cable is pulled or pushed through a conduit. In operation 1003, the coax cable is connected to an antenna of a distributed antenna system.

Figure 11:
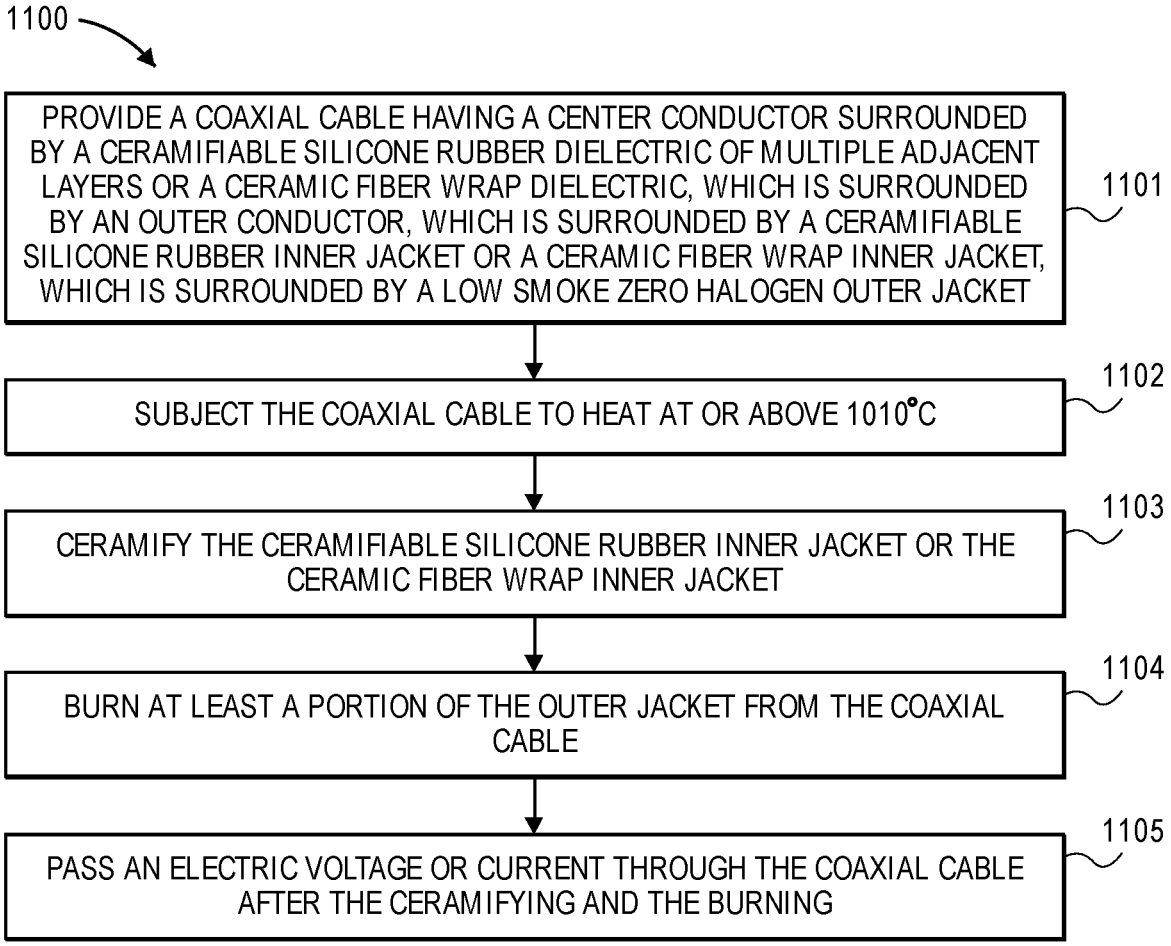
FIG. 11 is a flowchart of a process in accordance with an embodiment.

FIG. 11 is a flowchart of process 1100 in accordance with an embodiment. In operation 1001, a coaxial cable having a center conductor surrounded by a ceramifiable silicone rubber dielectric of multiple adjacent layers or a ceramic fiber wrap dielectric, which is surrounded by an outer conductor, which is surrounded by a ceramifiable silicone rubber inner jacket or a ceramic fiber wrap inner jacket, which is surrounded by a low smoke zero halogen outer jacket, is provided. In operation 1102, the coax cable is subjected to heat at or above 1010° C. In operation 1103, the ceramifiable silicone rubber inner jacket or the ceramic fiber wrap inner jacket is ceramified. In operation 1104, at least a portion of the outer jacket of the coaxial cable is burned. In operation 1105, an electric voltage or current is passed through the coaxial cable after the ceramifying and burning.

Although specific embodiments of the invention have been described, various modifications, alterations, alternative constructions, and equivalents are also encompassed within the scope of the invention. Embodiments of the present invention are not restricted to operation within certain specific environments, but are free to operate within a plurality of environments. Additionally, although method embodiments of the present invention have been described using a particular series of and steps, it should be apparent to those skilled in the art that the scope of the present invention is not limited to the described series of transactions and steps.

Further, while embodiments of the present invention have been described using a particular combination of hardware, it should be recognized that other combinations of hardware are also within the scope of the present invention.

The specification and drawings are, accordingly, to be regarded in an illustrative rather than a restrictive sense. It will, however, be evident that additions, subtractions, deletions, and other modifications and changes may be made thereunto without departing from the broader spirit and scope.

What is claimed is:

1. A method of testing a fire resistant coaxial cable, the method comprising:

providing a coaxial cable having a center conductor surrounded by a ceramifiable silicone rubber dielectric, which is surrounded by an outer conductor, which is surrounded by a ceramifiable silicone rubber inner jacket, which is surrounded by an outer jacket;

subjecting the coaxial cable to heat at or above 1010° C.;

ceramifying the ceramifiable silicone rubber inner jacket, wherein the ceramifying includes burning away a polysiloxane matrix and melting inorganic flux particles such that the inorganic flux particles connect between refractory filler particles;

burning at least a portion of the outer jacket from the coaxial cable; and passing an electric voltage or current through the coaxial cable after the ceramifying and the burning.

2. The method of claim 1 further comprising:

resting the coaxial cable on a metal surface, wherein the burning of the outer jacket exposes the ceramifiable silicone rubber inner jacket to the metal surface, the ceramifiable silicone rubber inner jacket preventing the outer conductor from contacting the metal surface.

3. The method of claim 1 wherein the ceramifiable silicone rubber dielectric includes:

a first layer of ceramifiable silicone rubber dielectric surrounding the center conductor, the ceramifiable silicone rubber dielectric comprising inorganic flux particles and refractory particles in a polysiloxane matrix, the ceramifiable silicone rubber dielectric configured to convert from a resilient elastomer to a porous ceramic; and a second layer of ceramifiable silicone rubber dielectric surrounding the first layer, the first layer having at least partially cured independently from the second layer such that the first and second layers are distinct from one another.

4. The method of claim 3 wherein the first layer of ceramifiable silicone rubber dielectric was cured completely separately from the second layer such that there exists no cross-linking of polymer chains between the first and second layers.

5. The method of claim 3 wherein the coaxial cable further comprises:

a third layer of ceramifiable silicone rubber dielectric surrounding the second layer, the second layer having at least partially cured independently from the third layer such that the second and third layers are distinct from one another.

6. The method of claim 3 wherein the coaxial cable further comprises:

a plastic film between the second layer of ceramifiable silicone rubber dielectric and the outer conductor.

7. The method of claim 1 wherein the center conductor comprises a single solid wire or multiple strands of wire.

8. The method of claim 1 wherein the ceramifiable silicone rubber dielectric directly touches the center conductor.

9. The method of claim 1 wherein the ceramifiable silicone rubber dielectric has a layer thickness greater than 4.2 millimeters.

10. The method of claim 1 wherein the outer conductor comprises:

a metal foil; and a metal braid surrounding and in electrical contact with the metal foil.

11. The method of claim 1 wherein the outer conductor comprises a corrugated metal.

12. The method of claim 1 further comprising:

an inner jacket, which comprises:

a plastic sheath; and a ceramifiable silicone rubber jacket surrounding the plastic sheath.

13. The method of claim 1 wherein the outer jacket comprises:

a low smoke zero halogen (LSZH) outer jacket.

14. A method of testing a fire resistant coaxial cable, the method comprising:

providing a coaxial cable having a center conductor surrounded by a ceramifiable silicone rubber dielectric, which is surrounded by an outer conductor, which is surrounded by a ceramifiable silicone rubber inner jacket or a ceramic fiber wrap inner jacket, which is surrounded by an outer jacket, wherein the ceramifiable silicone rubber dielectric includes:

a first layer of ceramifiable silicone rubber dielectric surrounding the center conductor, the ceramifiable silicone rubber dielectric comprising inorganic flux particles and refractory particles in a polysiloxane matrix, the ceramifiable silicone rubber dielectric configured to convert from a resilient elastomer to a porous ceramic; and a second layer of ceramifiable silicone rubber dielectric surrounding the first layer, the first layer having at least partially cured independently from the second layer such that the first and second layers are distinct from one another;

subjecting the coaxial cable to heat at or above 1010° C.;

ceramifying the ceramifiable silicone rubber inner jacket or the ceramic fiber wrap inner jacket;

burning at least a portion of the outer jacket from the coaxial cable; and passing an electric voltage or current through the coaxial cable after the ceramifying and the burning.

15. The method of claim 14 wherein the first layer of ceramifiable silicone rubber dielectric was cured completely separately from the second layer such that there exists no cross-linking of polymer chains between the first and second layers.

16. The method of claim 14 wherein the coaxial cable further comprises:

a third layer of ceramifiable silicone rubber dielectric surrounding the second layer, the second layer having at least partially cured independently from the third layer such that the second and third layers are distinct from one another.

17. The method of claim 14 wherein the coaxial cable further comprises:

a plastic film between the second layer of ceramifiable silicone rubber dielectric and the outer conductor.

18. A method of testing a fire resistant coaxial cable, the method comprising:

providing a coaxial cable having a center conductor surrounded by a ceramic fiber wrap dielectric, which is surrounded by an outer conductor, which is surrounded by a ceramic fiber wrap inner jacket comprising fiber material selected from the group consisting of refractory aluminoborosilicate, aluminosilica, and alumina, which is surrounded by an outer jacket;

subjecting the coaxial cable to heat at or above 1010° C.;

burning at least a portion of the outer jacket from the coaxial cable; and passing an electric voltage or current through the coaxial cable after the burning.

19. The method of claim 18 wherein the outer conductor comprises a corrugated metal.

* * * * *